United States Patent [19]

Long et al.

[11] 4,233,800

[45] Nov. 18, 1980

[54] ENVELOPE OPENER

[75] Inventors: William J. Long, Birmingham; Larry W. Roberts, Fairfield; H. Ross Williams, Birmingham, all of Ala.

[73] Assignee: Amer-O-Matic Corporation, Birmingham, Ala.

[21] Appl. No.: 971,273

[22] Filed: Dec. 20, 1978

Related U.S. Application Data

[63] Continuation-in-part of Ser. No. 826,613, Aug. 22, 1977, Pat. No. 4,142,430.

[51] Int. Cl.[3] ..... B43M 7/02

[52] U.S. Cl. ..... 53/381 R; 83/262; 83/395; 83/583; 83/591; 83/912

[58] Field of Search ..... 83/262, 395, 583, 591, 83/595, 674, 912; 271/246, 245; 53/381

[56] References Cited

U.S. PATENT DOCUMENTS

| | | | |
|---|---|---|---|
| 1,098,510 | 6/1914 | Krauth | 83/596 X |
| 1,148,963 | 8/1915 | Gammeter | 271/246 |
| 3,143,100 | 8/1964 | Krupotich | 53/381 R |
| 3,238,926 | 3/1966 | Huck | 83/262 X |
| 3,263,992 | 8/1966 | Schrempp | 271/246 |
| 3,813,982 | 6/1974 | Waibel | 83/583 X |
| 3,888,478 | 6/1975 | Alderman | 271/245 X |
| 4,114,491 | 9/1978 | Hashimoto et al. | 83/583 X |
| 4,146,326 | 3/1979 | Taylor | 271/246 X |

FOREIGN PATENT DOCUMENTS

| | | | |
|---|---|---|---|
| 477536 | 6/1929 | Fed. Rep. of Germany | 83/583 |

*Primary Examiner*—J. M. Meister

*Attorney, Agent, or Firm*—Seidel, Gonda, Goldhammer & Panitch

[57] ABSTRACT

An improved envelope opener comprising first, second and third shear stations for shearing three edges of an envelope in sequence one edge at a time. Each shear station sequentially aligns the envelope by contacting the edge to be sheared, shears the contacted edge, and then releases the envelope. Each shear station includes a self-sharpening and self-aligning anvil assembly comprising a pivotable anvil which is spring-urged to an adjustable home position. The home position of the anvil is adjusted by means of a rotatable eccentric stop. During a shearing operation, the anvil is pivoted away from and then back towards the home position. An overly thick envelope will keep the anvil pivoted away from the home position to avoid a jam condition at the shear station. A peel back station downstream of the last shear station peels back the top panel of the envelope to expose the contents thereof. The peel back station comprises a pivotable gate, a support rod, and a pivotable separation roller and an exit roller both of which are pivotable upwardly. The support rod is disposed in proximity to the gate stop, and the gate and rod support an envelope in the station as the envelope panels are first peeled back and then transported through the station. The separation and exit rollers are pivoted upwardly by an overly thick envelope, to enable the envelope to pass through the peel back station without causing a jam condition.

12 Claims, 28 Drawing Figures

FIG. 12
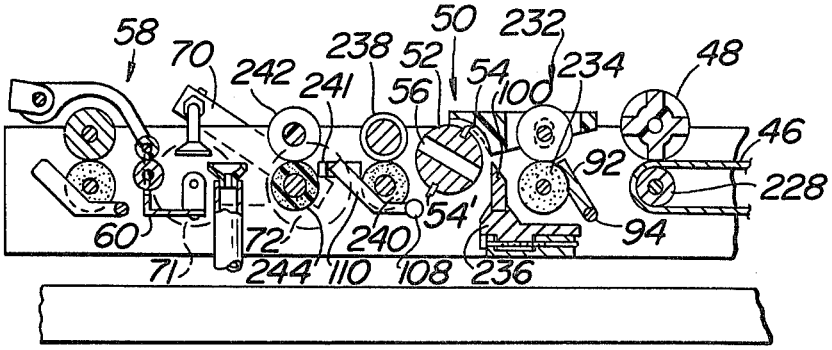
FIG. 13
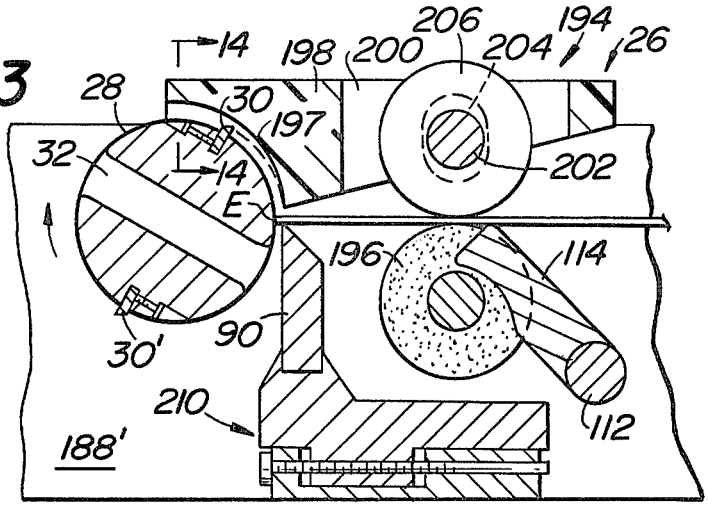
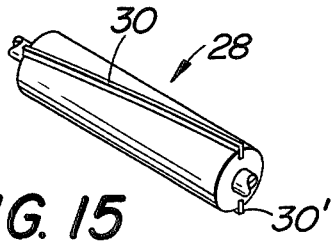
FIG. 15
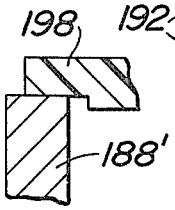
FIG. 14
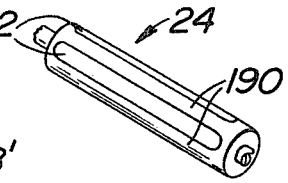
FIG. 18

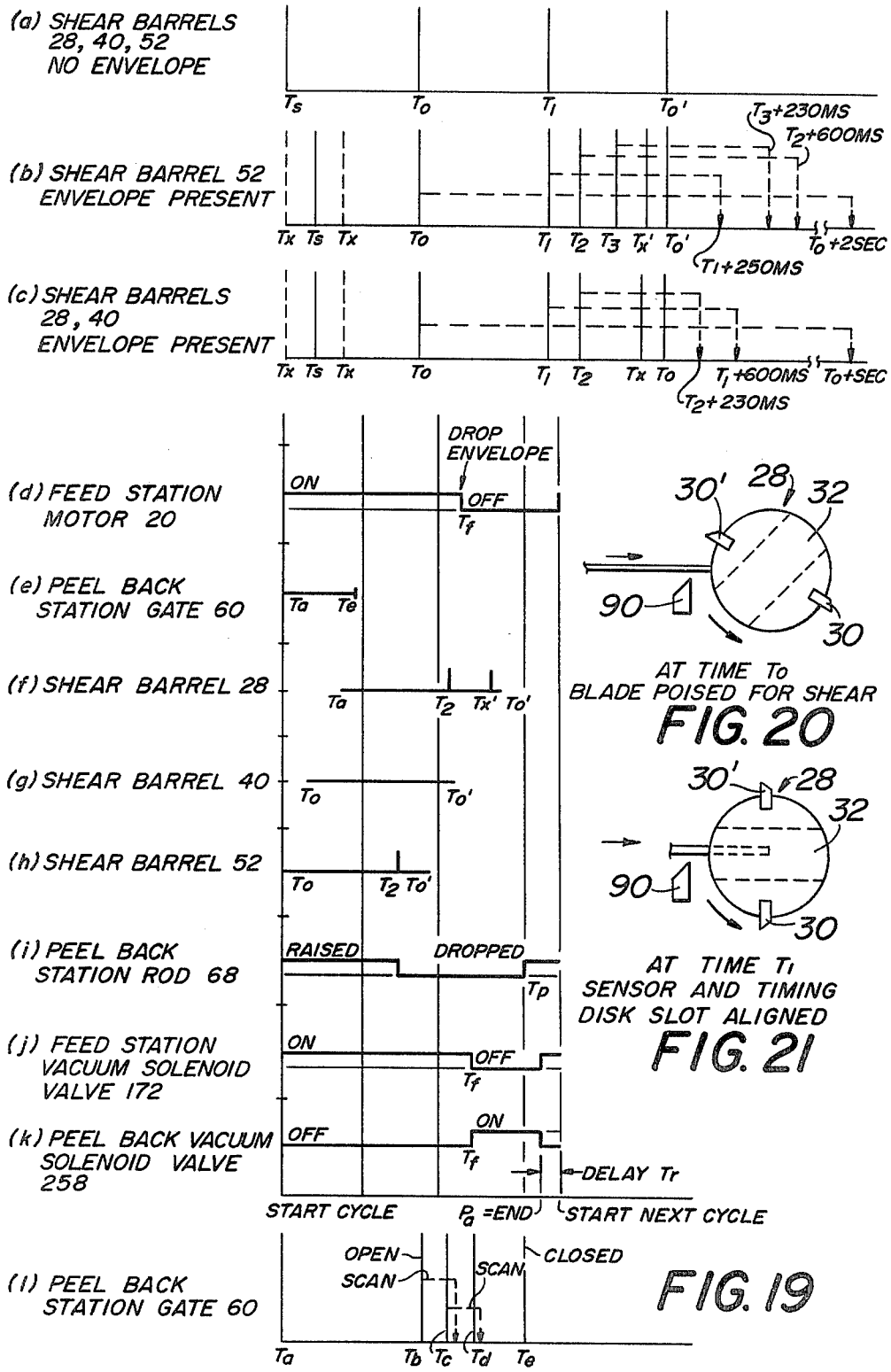
(a) SHEAR BARRELS 28, 40, 52 NO ENVELOPE
Ts
To
T1
To'
T3+230MS
T2+600MS
(b) SHEAR BARREL 52 ENVELOPE PRESENT
Tx Ts Tx
To
T1 T2 T3 Tx' To'
To+2SEC
T1+250MS
(c) SHEAR BARRELS 28, 40 ENVELOPE PRESENT
Tx Ts Tx
To
T1 T2
Tx To
T1+600MS
To+SEC
T2+230MS
DROP ENVELOPE
(d) FEED STATION MOTOR 20
ON
OFF
Tf
(e) PEEL BACK STATION GATE 60
Ta Te
(f) SHEAR BARREL 28
Ta
T2 Tx' To'
(g) SHEAR BARREL 40
To
To'
(h) SHEAR BARREL 52
To
T2 To'
(i) PEEL BACK STATION ROD 68
RAISED
DROPPED
Tp
(j) FEED STATION VACUUM SOLENOID VALVE 172
ON
OFF
Tf
(k) PEEL BACK VACUUM SOLENOID VALVE 258
OFF
ON
Tf
DELAY Tr
START CYCLE
Pa =END
START NEXT CYCLE
(l) PEEL BACK STATION GATE 60
OPEN
SCAN
SCAN
CLOSED
Ta
Tb Tc Td Te
30'
28
32
90
30
AT TIME To
BLADE POISED FOR SHEAR
FIG. 20
30'
28
32
90
30
AT TIME T1
SENSOR AND TIMING
DISK SLOT ALIGNED
FIG. 21
FIG. 19

FIG. 27
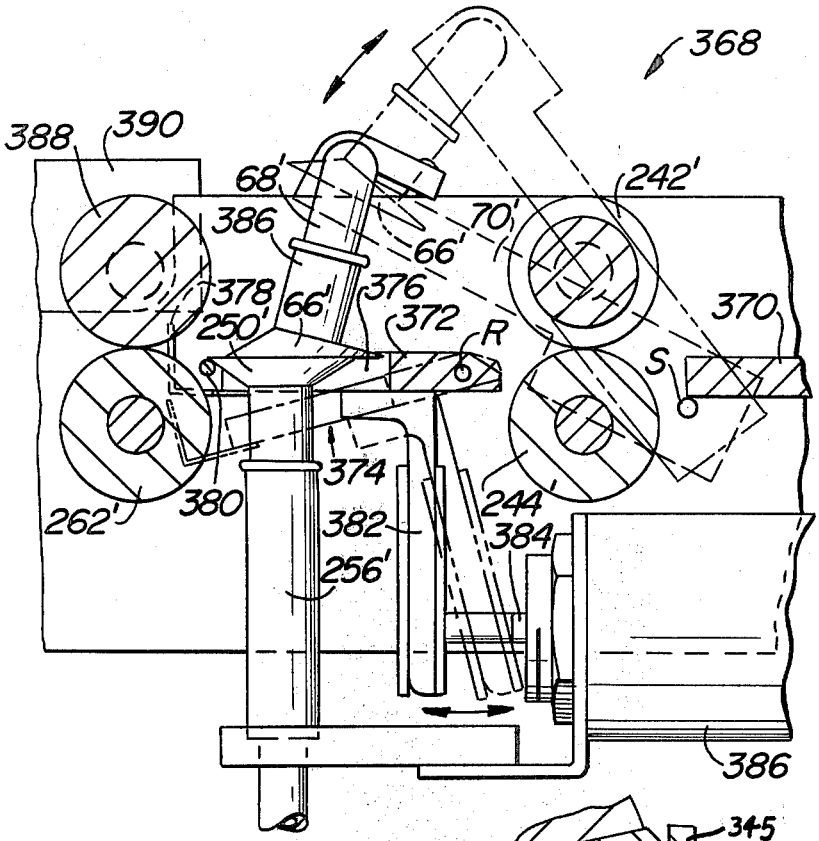
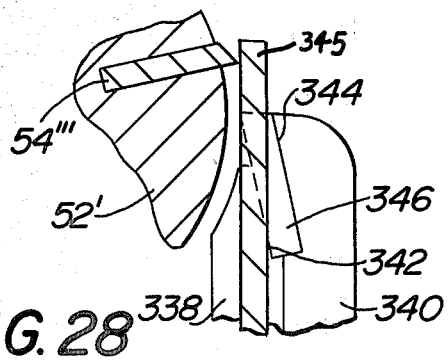
FIG. 28

ENVELOPE OPENER

RELATED CASE

This is a continuation-in-part application based on copending U.S. Pat. application Ser. No. 826,613 for "Envelope Opener" filed Aug. 22, 1977 now U.S. Pat. No. 4,142,430, assigned to the assignee herein.

BACKGROUND OF THE INVENTION

The present invention is directed to an improved envelope opener. In particular, the invention is directed to an improved shear station and peel back station for an envelope opener in which the edges of an envelope are sheared one edge at a time under control of a microcomputer.

Automatic envelope openers are known in the art. For example, see U.S. Pat. Nos. 3,590,548, 3,764,049, 3,875,722 and 3,822,523. Heretofore, high speed automatic envelope openers operated at fixed rates under control of relatively primitive electromechanical components. In certain envelope opening machines, three edges of the envelope had to be pre-weakened before the envelope could be opened and its contents exposed. In other machines, the edge of the envelope to be sheared was aligned for shearing by contacting one or more of the remaining envelope edges. This frequently resulted in misalignment of the envelope and, accordingly, incomplete severing of an envelope edge. In addition, such machines required cumbersome mechanism structure for guiding and aligning the envelope immediately prior to shearing.

In U.S. Pat. application Ser. No. 826,613, there is disclosed an envelope opening machine which can monitor the advance of an envelope through the machine. Such an envelope opening machine is fully automated and continuously operated under the control of a microcomputer. The envelope opening machine is capable of automatically indicating a jam condition and automatically shutting down under such condition. The present invention is directed to an improved shear station and peel back station for such a machine. The improved shear station includes a self-sharpening and self-aligning anvil assembly. The improved shear and peel back stations are able to transport overly thick envelopes which might otherwise cause a jam condition at the stations.

SUMMARY OF THE INVENTION

In an envelope opener having plural shear stations for sequentially shearing at least three edges of an envelope and a peel back station for peeling back a panel of the envelope to expose the contents thereof, the improvement of a shear station and a peel back station which reliably transport overly thick envelopes which might otherwise cause a jam condition. A shear station includes a self-sharpening and self-aligning anvil assembly comprising a pivotable anvil which is spring-urged to an adjustable home position. During a shearing operation, the anvil is pivoted away from and then back towards the home position. The envelope is sheared as the anvil is returning "on the fly" to the home position but before the anvil reaches the home position. An overly thick envelope will keep the anvil pivoted away from the home position to avoid a jam condition at the shear station. The peel back station includes a pivotable gate and a support rod disposed in proximity to the gate for supporting the envelope as the envelope panels are first peeled back and then transported through the station. The station further comprises a separation roller and an exit roller both of which are pivotable upwardly. Both rollers are displaced upwardly by an overly thick envelope to enable the envelope to pass through the peel back station without causing a jam condition.

An advantage of the invention is that the anvil assembly of a shear station is self-aligning and self-sharpening.

Another advantage of the invention is that overly thick envelopes are transported through the shear and peel back stations without causing a jam condition.

Other advantages appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 12 is a cross-section of the third shear station and the peel back station of FIG. 1 taken along the lines 12—12 in FIG. 9.

FIG. 13 is a cross-section of any shear station of the envelope opener of FIG. 1 showing the rotatable barrel, anvil and idler means.

FIG. 14 is a cross-section of the idler means and side panel taken along the lines 14—14 in FIG. 13.

FIG. 15 is an isometric of a rotatable shear station barrel.

FIG. 18 is an isometric of a grooved roller.

FIG. 19 is a timing diagram showing the cyclic operation of the envelope opener of FIG. 1.

FIGS. 20 and 21 show two positions of the rotatable barrel at the times indicated in FIG. 19.

FIG. 27 is an enlarged partial cross-section of the peel back station.

FIG. 28 is an enlarged partial cross-section of the anvil assembly of FIG. 26.

DETAILED DESCRIPTION OF THE INVENTION

Figures 1, 2, 3, 4, 5:
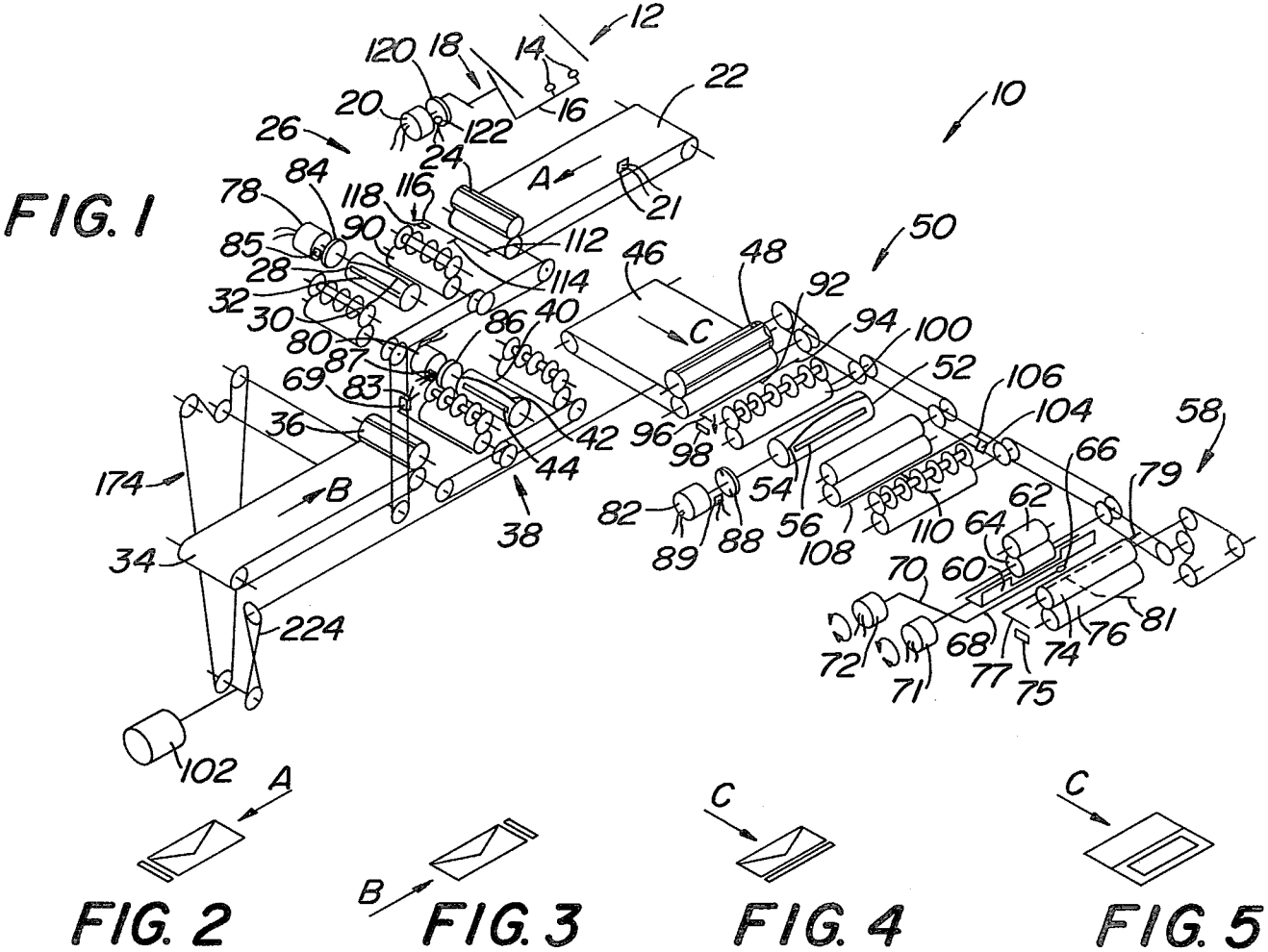
FIG. 1 is a diagrammatic representation of a microprocessor controlled envelope opener which shears at least three edges of an envelope.
FIGS. 2–5 show a sequence in which the envelope edges are sheared and the envelope panels peeled to expose the contents thereof.

Referring to the drawings in detail, wherein like numerals indicate like elements, there is shown in FIG. 1 a microprocessor controlled envelope opener 10. A batch of envelopes is stored in a feed station 12. Each envelope in the batch is removed from the feed station 12 by a pair of suction cups 14. The suction cups are mounted on a swingable rod 16. The rod 16 is driven through a crank 18 by a motor 20. Motor 20 is a singler evolution motor. The cups 14 pick up an envelope in the feed station, the crank 18 swings the rod 16 over a conveyor 22, and the cups release the envelope to deposit the envelope on the conveyor. The conveyor 22 is driven through a chain and sprocket assembly 174 and belts and pulleys by a main driven motor 102.

The conveyor 22 transports the envelope in the direction indicated by arrow A to a grooved roller 24 which flattens any ruffles in the envelope. Thereafter, the envelope enters a first shear station 26. The station includes a rotatable barrel 28 having a pair of shear blades 30, 30′ mounted on opposite sides thereof. A longitudinal opening 32 is intermediate the blades 30, 30′. The edge of the envelope to be sheared contacts the barrel 28. The barrel 28 automatically aligns the envelope for shearing in this manner. The barrel then rotates, and one of the shear blades 30, 30′ contacts the leading edge of the envelope to shear the edge in cooperation with an anvil 90. Thereafter, the barrel rotates to align the opening 32 with the envelope. The envelope then passes through the opening 32.

The envelope, with its leading edge sheared, continues to travel in the direction A and falls under gravity onto a conveyor 34. Conveyor 34 is driven through chain and sprocket assembly 174 by main drive motor 102. The conveyor 34 transports the envelope in the direction indicated by the arrow B. Direction B is opposite to direction A. Accordingly, the envelope edge opposite the sheared edge becomes the leading edge of the envelope. The envelope passes under a grooved roller 36 identical to roller 24. The roller 36 flattens the envelope and feeds it to a second shear station 38 identical in structure and operation to first shear station 26.

The second shear station comprises a rotatable barrel 40 identical to barrel 28. Barrel 40 is provided with a pair of shear blades 42, 42′ mounted on opposite sides of a longitudinal opening 44. The leading edge of the envelope contacts the barrel 40 to align the envelope. The barrel rotates to shear the leading edge of the envelope in cooperation with an anvil identical to anvil 90, and rotates to align the opening 44 with the envelope as already described in connection with first shear station 26. The envelope then passes through the opening 44 to a conveyor 46. Conveyor 46 is driven through a twisted belt by main drive motor 102.

Conveyor 46 transports the envelope in the direction indicated by arrows C. Direction C is transverse to and preferably perpendicular to directions A and B. Accordingly, the bottom edge of the envelope between the sheared edges becomes the leading edge of the envelope. The envelope passes under a grooved roller 48 identical to rollers 24 and 36. Roller 48 flattens the envelope and feeds it to a third shear station 50. Third shear station 50 aligns and shears the leading edge of the envelope in the same manner as shear stations 26 and 28. The leading edge of the envelope contacts a rotatable barrel 52 identical to barrels 28 and 40. The barrel is provided with a pair of shear blades 54, 54′ mounted on opposite sides of a longitudinal opening 56. The barrel aligns the envelope, shears the leading edge of the envelope, and rotates to align the opening 56 with the envelope. The envelope passes through the opening to a peel back station 58.

At the peel back station 58, a gate 60 is raised under control of a solenoid 71 to arrest the envelope while the top panel of the envelope is lifted or peeled back. The envelope moves through rollers 62 and 64 into position between suction cups 66 and 250. Suction cup 66 is mounted on a rod 68 connected to linkage arm 70 driven eccentrically by a motor 72. Suction cup 250 is stationary. Suction cup 66 grips the top panel of the envelope and suction cup 250 grips the bottom panel. Suction cup 66 is lifted and swung against the direction of movement of the envelope to peel back the top panel of the envelope and expose the contents thereof. The opened envelope passes through rollers 74 and 76 to the delivery end of the machine.

The sequence in which the envelope edges are sheared at the first, second and third shear stations 26, 38 and 50 is shown in FIGS. 2–4. The envelope, with the top panel peeled back by the peel back station 58, is shown in FIG. 5.

Timing

The timed operation of the components of envelope opener 10 is shown in FIG. 19.

Each of the shear station barrels 28, 40 and 52 is driven by a separate motor under control of a microcomputer described hereinafter. Barrel 28 is driven by motor 78. See FIG. 1. Barrel 40 is driven by motor 80. Barrel 52 is driven by motor 82. Motors 78, 80 and 82 are reversible motors. Each motor drives a timing disk in synchronism with the associated barrel. Timing disk 84 is driven by motor 78. Timing disk 86 is driven by motor 80. Timing disk 88 is driven by motor 82. Each timing disk is associated with a lamp and a light sensor disposed on opposite sides of the disk in proximity to the circumferential edge of the disk. Sensor 85 is associated with disk 84. Sensor 87 is associated with disk 86. Sensor 89 is associated with disk 88. Each disk is provided with a pair of diametrically opposite slots along its circumferential edge. A slot permits the passage of light from the lamp to the sensor when the slot and the sensor are in alignment. Intermediate the slots, however, the disk blocks light from reaching the sensor. The disk slots and sensors, therefore, serve to indicate the angular position of the barrels 28, 40 and 52.

A. Timed Operation Of Shear Station With No Envelope Present

On the application of power to envelope opener 10, each of the barrels 28, 40 and 52 is rotated to set the barrel up for operation. The rotation of the timing disks and barrels in the set-up sequence is shown in chart (a) in FIG. 19 for the condition of no envelope present at the shear station. For purposes of explanation, the timed operation of shear station 26 only is described. It should be understood, however, that the timed operation of shear stations 38 and 50 is the same for the condition of no envelope present.

At time Ts following the application of power, a slot on timing disk 84 moves into alignment with sensor 85. The sensor relays this information to the microcomputer by a change in output. The microcomputer causes the motor 78 to drive barrel 28 to the position shown in FIG. 20. The barrel reaches this position at time T0. The barrel is driven at approximately 45 rpm. The interval Ts–T0 is approximately 230 milliseconds. Thus, the interval Ts–T0 is fixed by the angular position of the slot on disk 84 compared with the angular position of barrel 28 as well as the speed at which the barrel is driven.

At time T0, the barrel 28 is in position to shear an edge of an envelope although none is present. See FIG. 20. The opening 32 and the shear blade 30 will be poised for shearing. Since no envelope is present, the microcomputer causes the motor 78 to continue to rotate the barrel 28. Blade 30 rotates past the stationary anvil 90 while opening 32 moves into lateral alignment. See FIG. 21. The opening is aligned in this position at time T1. The time interval T0–T1 is approximately 400 milliseconds. At time T1, the opposite slot on the disk moves into aligment with the sensor. The microcomputer detects this condition and causes motor 78 to maintain the barrel stationary.

Prior to the time T0, the presence or absence of an envelope at the station is detected by a microswitch 118 associated with barrel 28 as disclosed in greater hereinafter. See FIG. 1. The microswitch relays this information to the microcomputer. If no envelope is at the shear station, the microcomputer causes motor 78 to rotate barrel 28 after briefly hesitating at time T1. See chart (a) in FIG. 19. Shear blade 30′ travels to the position wherein it is poised above the anvil 90. The blade reaches this position at time T0′. The time interval T1–T0′ is approximately 230 milliseconds. The microcomputer scans the sensor 85 and the microswitch and supervises motor 78 to drive barrel 28 as described above in repetitive cycles until an envelope is detected at the shear station.

B. Timed Operation Of Shear Station 50 With Envelope Present

Chart (b) of FIG. 19 shows the timed operation of third shear station 50 when an envelope is present at the shear station. The timed operation of shear station 50 with an envelope present is similar to that of operation of shear stations 26 and 38 but is somewhat more involved. The operation of shear stations 26 and 38 may be considered a special case of the operation of station 50 as will become apparent from the following description.

As the envelope travels in the direction C, its leading edge depresses a feeler arm 92 secured to a rotatable shaft 94 upstream of the barrel. See FIG. 1. This causes the shaft to rotate. As the shaft rotates, an actuator arm 96 secured to an end of the shaft triggers a mircoswitch 98. The microswitch is scanned by the microcomputer to determine whether the envelope is present at the shear station.

The microswitch 98 detects the presence of the leading edge of the envelope at time Tx. See chart (b) of FIG. 19. Time Tx is always prior to the time T0. At time Ts, the microcomputer detects alignment of one of the slots in timing disk 88 with sensor 89. The microcomputer causes motor 82 to drive barrel 52 to the position shown in FIG. 20. The barrel reaches this position at time T0. The interval Ts–T0 is approximately 230 milliseconds as already explained. When the barrel is in this position, the leading edge of the envelope will abut against the unslotted portion of the barrel. The leading edge of the envelope will be precisely aligned with the surface of the barrel at this time. No other structure is required to align the envelope.

At time T0, the microcomputer causes motor 82 to continue to rotate barrel 52 to the position shown in FIG. 21. The barrel reaches this position at time T1. The interval T0–T1 is approximately 440 milliseconds as already explained. As the barrel rotates, shear blade 54 cooperates with an anvil 100 to shear the leading edge of the envelope. See FIG. 1. At time T1, the longitudinal opening 56 will be in lateral alignment with the envelope. See FIG. 21. The envelope can then pass through the barrel opening. At this time, the opposite slot on disk 88 moves into alignment with the sensor 89.

Figure 22:
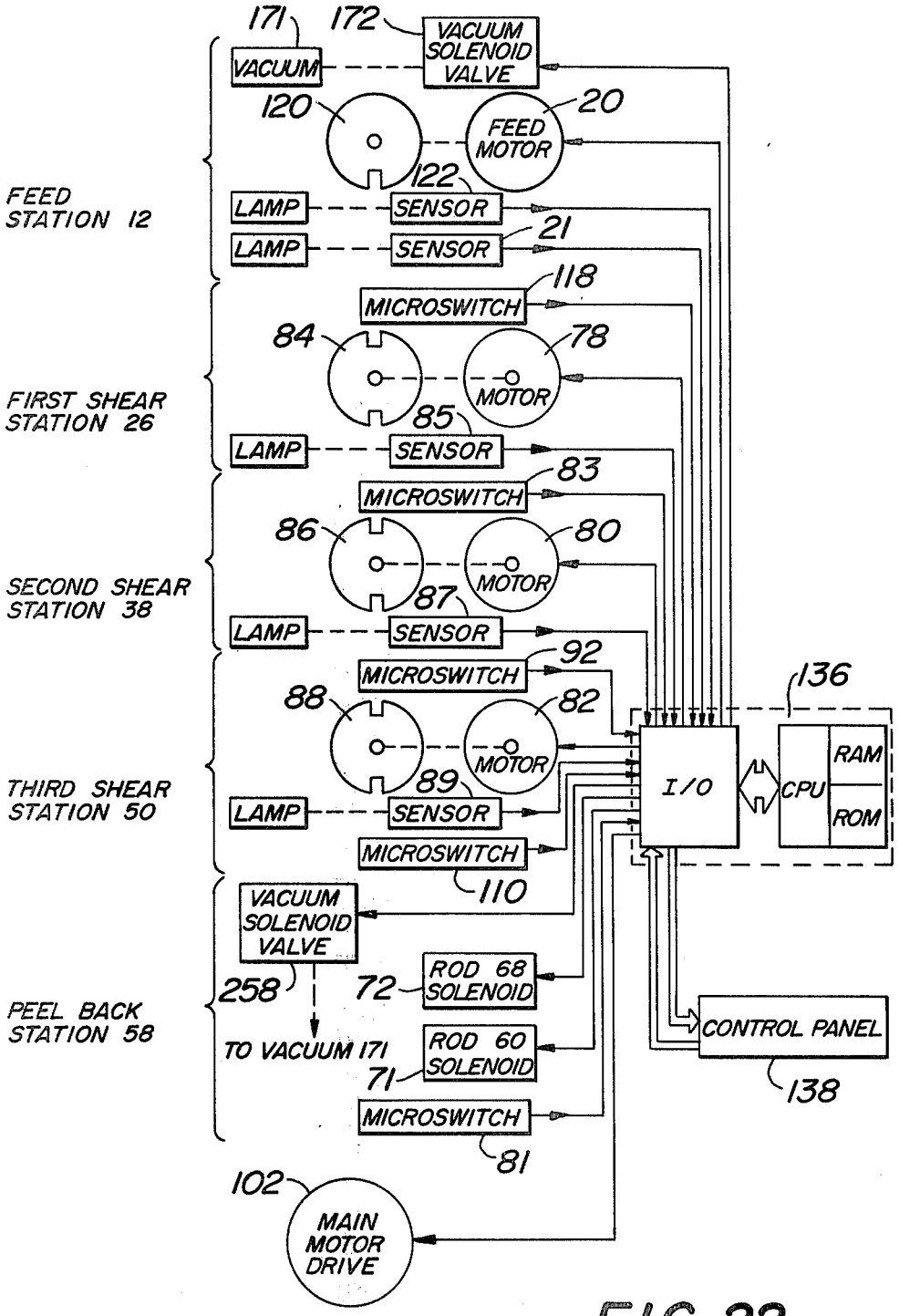
FIG. 22 is a block diagram of the microcomputer control architecture and interconnection with the sensing and drive components of the envelope opener.

The microcomputer scans sensor 89 for a 2 second window following time T0 to determine whether the second in disk 88 has moved into alignment with the sensor 89. Alignment of the slot and sensor occurs simultaneously with lateral alignment of the barrel opening 56. If the barrel opening has not moved into lateral alignment, the envelope will be jammed at the station. Accordingly, if the sensor output indicates that the sensor and slot are not aligned within the 2 second window, the microcomputer actuates a display to indicate a jam condition and, simultaneously, shuts off the main motor drive 102. See FIG. 1. The microcomputer also causes motor 82 to reverse direction to rotate barrel opening 56 into lateral alignment as shown in FIG. 22. The envelope can then be removed from the station for inspection.

If the second slot on the disk 88 moves into alignment with the sensor within the 2 second window, the microcomputer causes motor 82 to hesitate briefly with barrel 52 in the position shown in FIG. 21. This allows the envelope to pass through the barrel opening. The microcomputer then causes the motor to drive the barrel toward the position shown in FIG. 20 in preparation for the next shear operation.

The microcomputer scans a microswitch 104 downstream of barrel 52 to determine whether the envelope has passed through the barrel. See FIG. 1. The microswitch is operated by an actuator arm 106 secured to a rotatable shaft 108. A feeler arm 110 is secured to the shaft. If the envelope has passed through the barrel, the leading edge of the envelope will press against the feeler arm. This causes the shaft to rotate, triggering microswitch 104. The microcomputer scans the microswitch for approximately 250 milliseconds. If the envelope is jammed in barrel 52, microswitch 104 will not be triggered within the 250 millisecond window. The microcomputer detects this condition and actuates a display to indicate a jam condition while it shuts off the main motor drive 102.

If the envelope is not jammed in barrel 52, the downstream microswitch 104 will be triggered at time T2 within the 250 millisecond window. The microcomputer then scans microswitch 104 to determine whether the trailing edge of the sheared envelope has released the feeler arm 110 within a 600 millisecond window following time T2. If the envelope is jammed at the exit end of shear station 50, the trailing edge of the envelope will not reach the feeler arm 110 within the 600 millisecond window and the feller arm will not be released. The microcomputer detects this condition and actuates a display to indicate a jam condition while shutting off the main motor drive 102.

If the trailing edge of the envelope releases the feeler arm 110 at time T3 within the 600 millisecond window, themicrocomputer then scans the upstream microswitch 98 to determine whether the leading edge of a following envelope has reached shear station 50 within a 230 millisecond window following time T3. If the leading edge of a following envelope reaches the feeler arm 92 at time Tx' within the 230 millisecond window, the envelope could enter barrel opening 56 while the barrel is still being rotated to the position shown in FIG. 20. The envelope would not contact the surface of the barrel and would not be properly aligned for shearing. If the barrel continued to rotate, it could shear only part of the leading edge of the envelope and/or it could shear the entire leading edge and the contents of the envelope. If microswitch 98 indicates the presence of a following envelope within the 230 millisecond window, the microcomputer actuates a display to indicate a jam condition and shuts down the main motor drive 102. This prevents mutilation of the envelope and/or its contents due to further rotation of the barrel.

If the leading edge of the following envelope does not reach the feeler arm 92 within the 230 millisecond window, the microcomputer causes motor 82 to continue to rotate barrel 52 to the position shown in FIG. 20. The barrel will reach this position approximately 230 milliseconds after time T3. The microcomputer scans microswitches 98 and 104 and sensor 89 and supervises motor 82 to drive barrel 52 as described above in repetitive cycles as successive envelopes reach the shear station.

C. Timed Operation of Shear Station 26 And 38 With Envelope Present

The operation of first and second shear stations 26 and 38 is substantially similar to the operation of third shear station 50. For each station, the microcomputer scans a single microswitch up-stream of the station shear barrel in the same manner that it scans the pair of microswitches 98 and 104 at the third shear station. The first and second shear stations 26 and 38, however, detect the presence of the leading edge of the envelope only before the edge is sheared. The presence of the leading edge is not detected at these stations after it is sheared.

Operation of first and second shear stations 26 and 38 with an envelope present is shown in chart (c) of FIG. 19. The structure and operation of the first and second shear stations are identical. Accordingly, operation of first shear station 26 only will be described.

First shear station 26 includes a rotatable shaft 112 provided with a feeler arm 114 and an actuator arm 116. See FIG. 1. The actuator arm 116 operates a single microswitch 118 upstream of barrel 28. The leading edge of an envelope depresses the feeler arm 114, causing shaft 112 to rotate. Actuator arm 116 triggers microswitch 118. The Microcomputer scans microswitch 118 to detect the presence or absence of an envelope at the shear station. If no envelope is present at the shear station, the microcomputer supervises motor 78 and barrel 28 in accordance with the timing shown in chart (a) of FIG. 19.

If an envelope is present at the shear station, the microcomputer detects this condition at time Tx. See chart (c) in FIG. 19. Time Tx is always prior to the time TO. The microcomputer causes motor 78 to rotate barrel 28 to the position shown in FIG. 20 as already explained. The barrel reaches this position at time TO. Thereafter, the microcomputer causes motor 78 to rotate the barrel while the microcomputer scans sensor 85 to determine whether the barrel has reached the position shown in FIG. 21. The barrel reaches this position at time T1. In this position of the barrel, the second slot of the timing disk is in alignment with the sensor. During the time interval TO–T1, the shear blade 30 cooperates with anvil 90 to shear the leading edge of the envelope.

If the barrel does not rotate to the position shown in FIG. 21 within 2 seconds following time TO, the envelope will be jammed at the barrel surface. Accordingly, the microcomputer actuates a display to indicate a jam condition and, simultaneously, shuts off the main drive motor 102.

If the barrel reaches the position shown in FIG. 21 at time T1 within 2 seconds following time TO, the microcomputer causes the barrel to hesitate briefly to permit the envelope to pass through opening 32. The microcomputer then causes motor 78 to rotate the barrel to the position shown in FIG. 20.

While the barrel hesitates briefly at time T1, the microcomputer scans microswitch 118 to determine whether the trailing edge of the envelope has released the feeler arm 114 within 600 milliseconds following time T1. If the envelope is jammed within barrel opening 32, the trailing edge will not release the feeler arm within the 600 millisecond window. The microcomputer detects this condition via microswitch 118. Accordingly, the microcomputer actuates a display to indicate a jam condition and, simultaneously, shuts off the main motor drive 102.

If the envelope has passed through barrel opening 32, the trailing edge will release feeler arm 114 at time T2 within the 600 millisecond window. The microcomputer then scans the microswitch 118 to determine whether the leading edge of a following envelope has reached the feeler arm 114 within 230 milliseconds after time T2. During this time, the barrel 28 is being rotated to the position shown in FIG. 20. The barrel will reach this position at time TO'.

If the leading edge of a following envelope reaches the feeler arm 114 at time Tx' within the 230 millisecond window following time T2, the envelope may enter barrel opening 32 as the barrel is being rotated. Accordingly, the microcomputer actuates a display to indicate a jam condition and, simultaneously, shuts off the main motor dirve 102. The microcomputer scans microswitch 118 and sensor 85 and supervises motot 78 to drive barrel 28 as described above in repetitive cycles as successive envelopes reach the shear station.

D. Machine Cycle

Charts (d)–(k) in FIG. 19 show the operation of feed station 12, shear stations 26, 38 and 50, and peel back station 58 during one machine cycle. The machine cycle is repeated at a preselected rate as described hereinafter. The operation of the feed, shear and peel back stations during a machine cycle is controlled by the microcomputer. At the start of the machine cycle, the microcomputer causes a vacuum 171 to apply suction pressure to cups 14 on rod 16 via a solenoid valve 172. See FIGS. 1 and 22 and chart (j) of FIG. 19. The cups 14 grip an envelope in the feed station. The microcomputer causes the feed station motor 20 to swing rod 16 away from the feed station via crank 18.

Motor 20 drives timing disk 120 in synchronism with crank 18. The timing disk is provided with a single slot along its circumferential edge. A lamp and a light sensor 122 are disposed on opposite sides of the timing disk in proximity to the circumferential edge of the desk. See FIG. 1. The slot permits the passage of light to the sensor when the slot and sensor are in alignment. If the slot and sensor are not aligned, the disk blocks the light from reaching the sensor.

The vacuum 171 alternately supplies suction pressure to the feed station and the peel back station. While vacuum 171 applies suction pressure to the feed station via valve 172, a solenoid valve 258 connected between vacuum 171 and the peel back station cup 66 is maintained off. See FIG. 22 and charts (j) and (k) of FIG. 19. Accordingly, no suction is applied to peel back cup 66. Conversely, when solenoid valve 258 is opened to apply suction to cup 66, the solenoid valve 172 is maintained off. Accordingly, no suction is applied to feed cups 14.

When suction is applied to cups 14, the feed station motor 20 swings rod 16 to position the cups over conveyor 22. During this time, the barrels 28, 40 and 52 at the first, second and third shear stations effect a TO–TO′ cycle in accordance with charts (a)–(c) in FIG. 19 as already explained. When the cups 14 are in position over the conveyor 22, the slot in disk 20 moves into alignment with sensor 122. This occurs at time Tf. See chart (d) in FIG. 19. The microcomputer scans sensor 122 to detect whether the cups are in position over conveyor 22. If the sensor indicates that the cups are in position over the conveyor, the microcomputer stops motor 20. Thereafter, if the trailing edge of the envelope at the first shear station has released microswitch 118 or, no envelope being present at the first shear station, if the shear barrel has reached the position shown in FIG. 21, the microcomputer causes feed station solenoid valve 172 to remove suction from the cups 14. See charts (d) and (j) in FIG. 19. Accordingly, the cups 14 release the envelope, and the envelope drops onto conveyor 22. At this time, the microcomputer operates solenoid valve 258 to apply suction to cups 66 and 250 so that the cups can grip the top and bottom panels of the envelope; respectively, at the peel back station 58. See chart (k) in FIG. 19.

A light sensor 21 is disposed adjacent to conveyor 22 to detect the presence of an envelope as it drops onto the conveyor. See FIG. 1. The microcomputer scans sensor 21 to determine whether the envelope has been released by the cups 14. If the envelope has not been released by the cups, the microcomputer detects this condition at the output of sensor 21 and operates a display to indicate a jam condition while disabling the main motor drive 102.

At the beginning of the machine cycle, the microcomputer operates a solenoid 71 to swing peel back station gate 60 open. See FIG. 1 and chart (1) in FIG. 19. When the gate is opened, an envelope can pass over it. Solenoid 71 is operated by the microcomputer at time Ta. See chart (1) in FIG. 19. Approximately 50 milliseconds after the solenoid is operated, the gate 60 will reach the open position. This corresponds to time Tb.

At time Tb, the microcomputer scans microswitch 75 at the peel back station for a brief interval or window to determine whether the envelope has passed through rollers 74 and 76 to the delivery end of the machine. See FIG. 1 and chart (1) in FIG. 19. The microswitch 75 is triggered by an actuator arm 77 secured to a rotatable shaft 79. The shaft 79 is provided with a feeler arm 81 which is depressed by the envelope to cause rotation of the shaft. When the shaft rotates, actuator arm 72 triggers microswitch 75. If the feeler arm has been contacted by the leading edge of the envelope at time Tc, the microswitch 75 will be triggered. The microcomputer will detect this condition and again scan the microswitch for a brief interval to determine whether the feeler arm has been released by the trailing edge of the envelope. If the trailing edge of the envelope has released the feeler arm, the microcomputer detects this condition at the output of microswitch 75 and operates solenoid 71 to switch gate 60 closed. In the closed position, gate 60 holds an envelope in position below suction cup 66 to permit the envelope to be opened. The gate 60 will reach the closed position at time Te.

The microcomputer scans microswitch 75 for very brief periods of time following the times Tb and Tc as indicated in chart (1) in FIG. 19. If the leading edge of the envelope does not trigger the microswitch within the scan interval following time Tb, the microcomputer operates a display to indicate a jam condition and shuts down the main motor drive 102. Similarly, if the trailing edge of the envelope does not release the microswitch within the scan interval following the time Tc, the microcomputer operates a display to indicate a jam condition and shuts down the main motor drive 102.

At the beginning of the machine cycle, rod 68 is maintained in an elevated position at the peel back station by means of linkage arm 70 and solenoid 72. See FIG. 1 and chart (i) in FIG. 19. When a third shear station barrel 52 begins to be re-positioned for shear at time T2, the microcomputer operates solenoid 72 to lower rod 68 via linkage arm 70. See charts (h) and (i) in FIG. 19. In the lower position of rod 68, the suction cup 66 contacts the top side of the envelope at the peel back station. At time Tf, suction is applied to cups 66 and 250 as already explained. Cup 66 grips the top panel of the envelope. Cup 250 grips the bottom panel.

Figure 16:
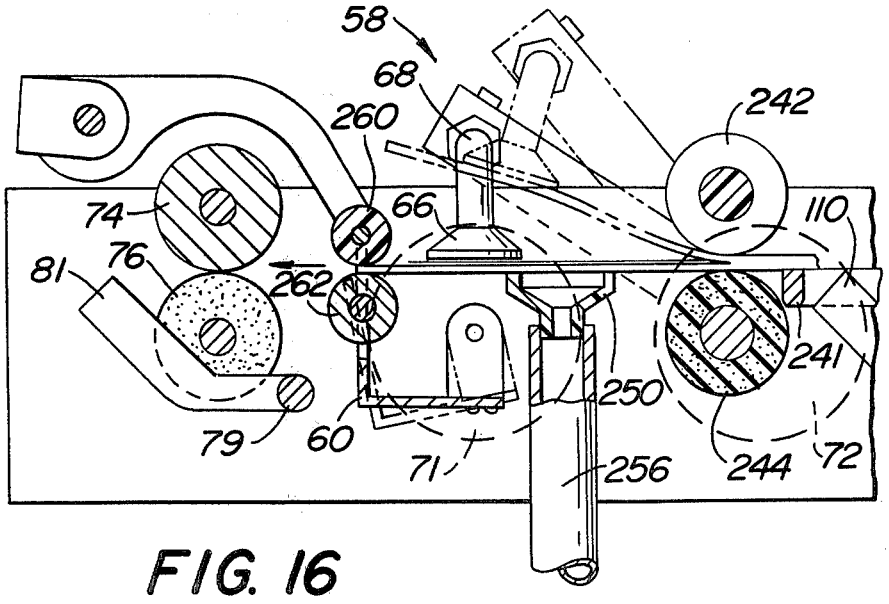
FIG. 16 is an enlarged cross-section of the peel back station of FIG. 1 in operation.

At time Tp, the microcomputer operates solenoid 72 to raise rod 68 while suction is applied to cup 66. See FIG. 1 and chart (i) in FIG. 19. Cup 250 remains stationary. Accordingly, suction cup 66 lifts or peels back the top panel of the envelope to expose the contents of the envelope. During this time, gate 60 remains closed. See charts (e) and (l) in FIG. 19. A brief period of time after rod 68 is raised to peel back the top panel of the envelope, the peel back solenoid valve 258 is shut off and the feed station solenoid valve 172 is turned on again. Accordingly, the feed and peel back stations are prepared for the next machine cycle. When solenoid valve 258 is shut off, suction is removed from cups 66 and 250. The cups release the envelope panels. The top panel of the envelope drops onto a spring-loaded roller 260, see FIG. 16, which performs the peel back functions as described more fully below. This marks the end of the machine cycle. The rod 68 remains in the raised position, with no suction applied to cups 66 and 250 until the next machine cycle is executed.

Figure 17:
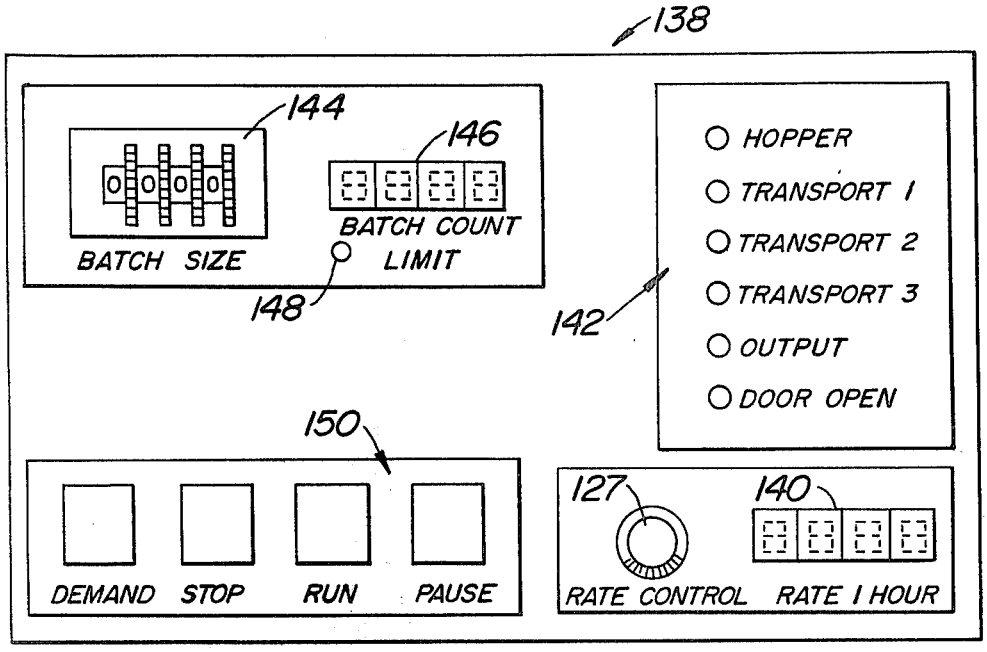
FIG. 17 is a drawing of the control panel.

The foregoing sequence of events defines a single machine cycle. The rate at which envelopes can be processed by the machine is determined by the rate of repetition of the machine cycle. Accordingly, the rate at which the machine can process envelopes is determined by varying the delay interval Tr between machine cycles. The delay interval Tr is varied by means of a rate control dial 127 at the machine control panel. See FIG. 17.

Rate Control

Figure 23:
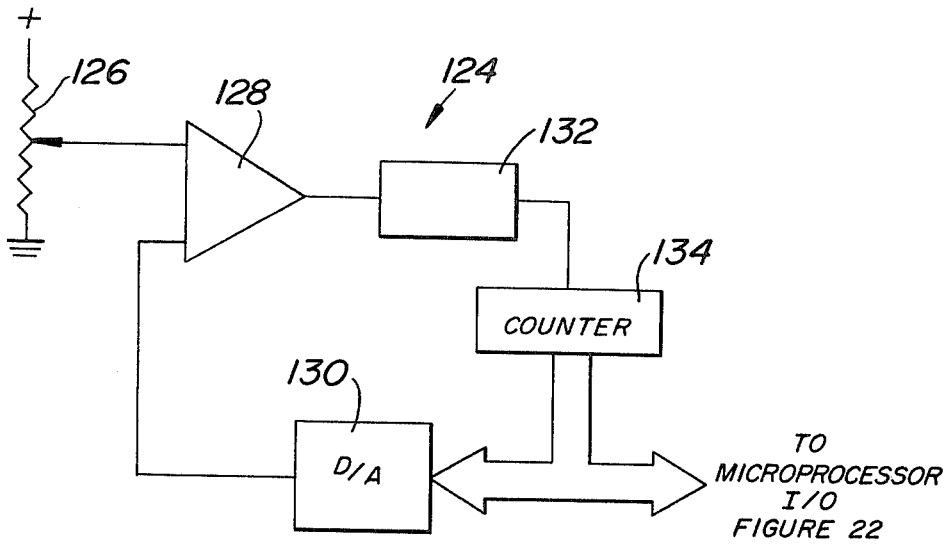
FIG. 23 is a block diagram of the rate control circuit.

Referring to FIG. 23, there is shown a rate control circuit 124 for controlling the repetition rate of the machine cycles. A rate control potentiometer 126 is operated by dial 127 located on the control panel. The potentiometer output is continuously compared by comparator 128 to the outpt of D/A converter 130. The output of comparator 128 gates a clock oscillator 132. The clock oscillator 132 increments a counter 134. The digital output of the counter 134 is converted by D/A converter 130 to an analog signal which is fed back to the comparator 128 and compared to the setting of potentiometer 126. The counter output represents the delay interval Tr between machine cycles. This output is scanned by the microprocessor.

When power is first applied to the envelope opener, an envelope is gripped by cups 14 and deposited at time Tf on conveyor 22. See chart (d) in FIG. 19. It takes one machine cycle for the envelope to reach the first shear station 26 and to be cut by shear barrel 28 at the station. See chart (f) in FIG. 19. During the following machine cycle, the envelope is processed through second shear station 38 where the opposite edge of the envelope is sheared. During the next machine cycle, the envelope is processed through third shear station 50 where the top edge is sheared. See chart (h) in FIG. 19. In the fourth machine cycle, the envelope is processed through peel back station 58 where the top panel of the envelope is peeled back by cup 66 and the contents of the envelope are exposed. Thus, it takes four machine cycles to process a single envelope through the machine.

During continuous operation of the machine, an envelope is deposited on conveyor 22 during each machine cycle. Each of the shear stations 26, 38 and 50 and the peel back station 58 will have an envelope present for processing. The peel back station will deliver a sheared and opened envelope at the end of every machine cycle. Accordingly, the rate at which the envelopes are processd is the inverse of the delay interval Tr between machine cycles. For the maximum processing rate, the delay Tr is approximately 0 seconds. If the machine cycle is assumed to be P0 seconds long, the maximum processing rate is therefore (1/P0) envelopes per second.

Microcomputer Interfacing

Interfacing between the machine components and the microcomputer is shown in FIG. 22. The microcomputer is designated generally as 136 and is an off-the-shelf item programmed to monitor the envelope opener as previously described. A typical program for controlling the microcomputer is annexed hereto as an addendum. The invention is not directed per se to such a program although it is understood that a microcomputer programmed in this manner will monitor the envelope opener components as described herein. Other programs, including obvious modifications to the program annexed hereto, may be employed without exceeding the spirit or scope of the invention.

The microcomputer 136 scans the light sensors and microswitches associated with the various machine stations to determine whether a jam condition has occurred at or between any of the stations. Detection of a jam condition as an envelope is being processed through a station has already been described. Detection of a jam condition between stations is described below.

The microcomputer scans and stores the states of the sensors and the microswitches during every machine cycle. This information is used by the microcomputer to determine the position of every envelope being processed by the machine. During the first machine cycle, the microcomputer detects the states of the sensors and microswitches and stores the information in temporary memory such as the cpu registers. In the first machine cycle, an envelope deposited on conveyor 22 is detected by light sensor 21 adjacent the conveyor. The conveyor transports the envelope to the first shear station 26. As the envelope enters the shear station, the leading edge of the envelope causes microswitch 118 to be triggered as already described. Thus, during the first machine cycle, the microcomputer stores the states of sensor 21 and microswitch 118 at the times they are actuated.

The microcomputer initiates the next machine cycle provided that no jam condition is indicated within a predetermined window, preferably 2 seconds, following the termination of the first machine cycle. If the envelope is jammed between stations 26 and 38, the microswitch 83 at shear station 38 will not be triggered within the 2 second window. The microcomputer detects this condition and actuates a display to indicate a jam condition while shutting down the main motor drive 102.

During the second machine cycle, the envelope is processed through the second shear station 38. the microprocessor detects release of microswitch 83 by the trailing edge of the envelope and stores this information in temporary memory. If the leading edge of the envelope does not trigger microswitch 98 at the third shear station 50 within another 2 second window, the microcomputer causes the display to indicate a jam condition and shuts off the main motor drive 102.

When the trailing edge of the envelope releases microswitch 64 at the third shear station, the microcomputer stores this information. The microcomputer then sets another window within which the leading edge of the envelope is expected to trigger microswitch 75 at the peel back station 58. If microswitch 75 is not triggered by the leading edge of the envelope within this window, the microcomputer causes the display to indicate a jam condition and shuts down the main motor drive 102.

Control Panel

The envelope opener includes a control panel 138. See FIG. 17. The control panel is provided with a rate control dial 127 coupled to potentiometer 126 in rate control circuit 124. See FIG. 23. The rate control dial 127 is adjusted by the operator to vary the delay interval Tr between machine cycles as already explained. The delay interval Tr is read off the output of counter 134 by the microcomputer. The microcomputer computes the processing rate based on the selected interval Tr and operates a four digit display 140 to display the computer rate. See FIG. 17.

A series of minuature lamps 142 is provided on the face of the control panel for indicating the position at which an envelope is jammed in the machine. Each of the lamps is connected to the I/O interface of the microcomputer 136. The microcomputer determines the address of the input port at which a jammed conditions is indicated by the sensors and/or microswitches. One or more of the lamps 142 is acutated to indicate the jam condition and the location of the jammed envelope based on the input port addresses. For example, a jam condition may be indicated at the microcomputer input ports connected to feed station sensor 21 and first shear station microswitch 118 as already described. Under these conditions, the microcomputer 136 will activate the "Hopper" lamp. In general, if any of the other sensor-microswitch combinations 85–83, 87–92 and/or 89–110 indicate a jam condition at the microcomputer input ports, the microcomputer will activate the "Transport 1", "Transport 2" and/or "Transport 3" lamps, respectively. Similarly, if a jam condition is indicated by microswitch 81 at the peel back station 58, the microcomputer will activate the "Output" lamp.

The control panel is also provided with a set of thumb wheel switches 144. These switches are manipulated by the operator to indicate the size of the batch of envelopes to be process by the machine. As each envelope is processed and delivered by the machine, the envelope triggers microswitch 75 at peel back station 58. The microcomputer counts the number of times that microswitch 75 is triggered. This corresponds to the number of envelopes processed by the machine. This count is used by the microcomputer to drive a four digit display 146. Display 146 provides a running indication of the number of envelopes processed by the machine. The microcomputer compares the setting of thumb wheel switches 144 to the count indicated by display 146. When equality of the thumb wheel switches and display count is detected by the microcomputer, the microcomputer actuates a lamp 148 to signal to the operator the completion of a batch operation.

The microcomputer also scans a series of pushbutton switches 150 on the control panel 138. These pushbottons may be used to signal any number of desired sequences of operation for the microcomputer. The microcomputer itself is programmed to respond to each of the switch as may be desired. For example, if the "Pause" pushbutton switch is depressed, the microcomputer will prevent the machine from executing another machine cycle after the current machine cycle is completed. Various other modes of operation of the machine may be effected by the microcomputer in response to external pushbotton signals or the like by providing appropriate programming for the microcomputer.

Detailed Mechanical Operation

A. Feed Station 12

Figure 8:
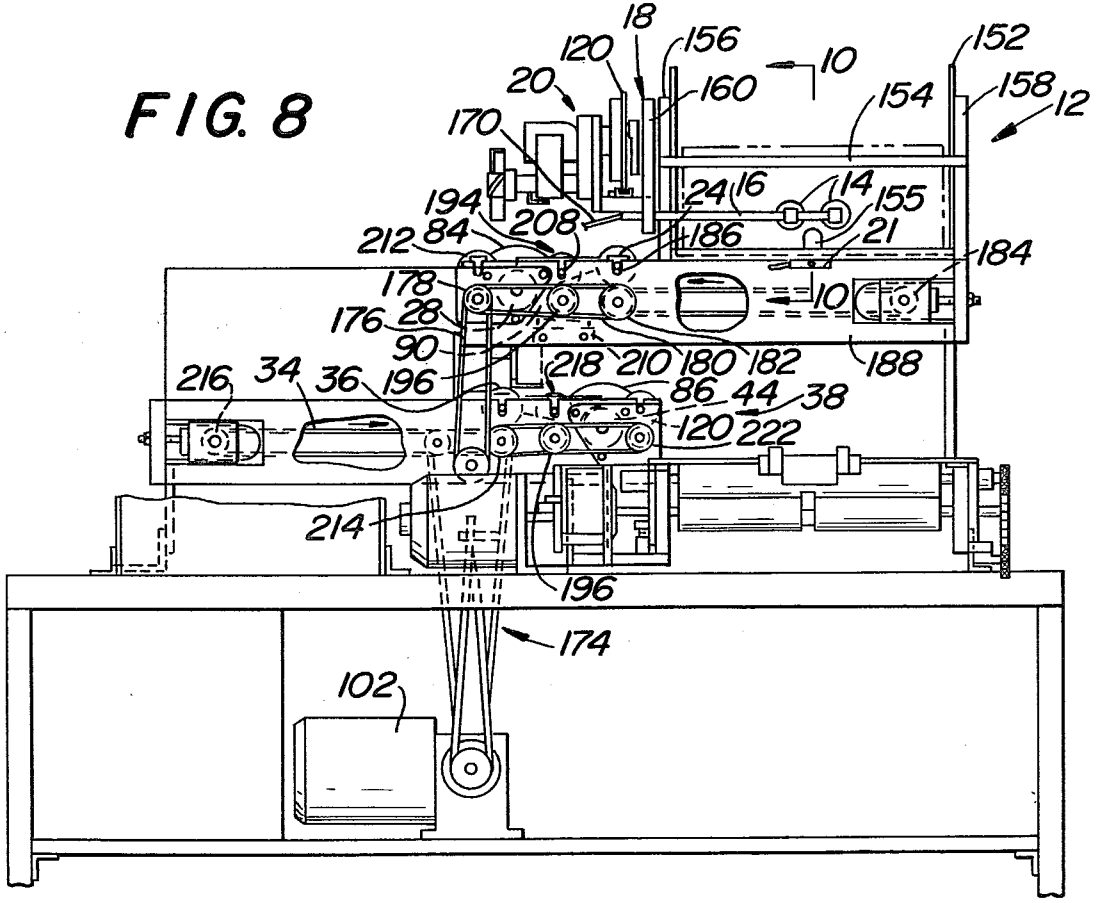
FIG. 8 is a front view of the envelope opener taken along the lines 8—8 in FIG. 7.
Figure 10:
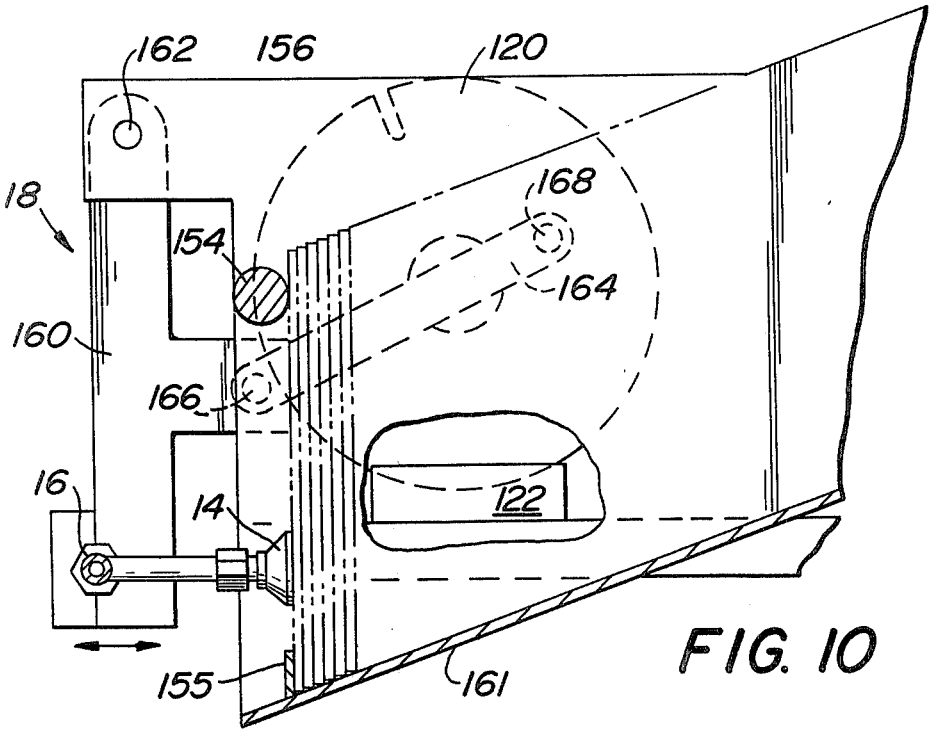
FIGS. 10 and 11 are details of the feed station in operation.

A batch of envelopes is loaded into a hopper 152 at feed station 12. See FIG. 8. The envelopes are held in position by a horizontal bar 154 and finger 155 fastened to side supports 156, 158 and bottom plate 161, respectively. The pair of suction cups 14 are secured to rod 16. Rod 16 is secured to a first pivotable member 160. Member 160 is pivotably mounted at pivot 162 on side support 156. See FIGS. 10 and 11. The first pivotable member 160 is also pivotable connected to a second pivotable member 164 at pivot 166. Second pivotable member 164 is pivotably mounted on timing disk 120 at an eccentric pivot 168. First and second pivotable member 160 and 164 comprise the crank 18. The crank reciprocates the rod 16 along an arc centered about pivot 162 in response to rotation of the timing disk 120 under power of motor 20.

A pressure conduit 170 such as flexible tubing or the like connects the rod 16 to the solenoid valve 172. See FIG. 8. Rod 16 is hollow and serves as a conduit between the suction cups and the tubing 170. At the beginning of a machine cycle, the microcomputer continuously operates the solenoid valve 172 in the open state so that suction pressure is applied through tubing 170 and rod 16 to cups 14. The motor 20 rotates rod 16 to bring suction cups 14 into contact with the first envelope in the batch. The suction cups grip the envelope and swing the envelope between bar 154 and finger 155 away from the feed station as shown in FIG. 11.

Figure 11:
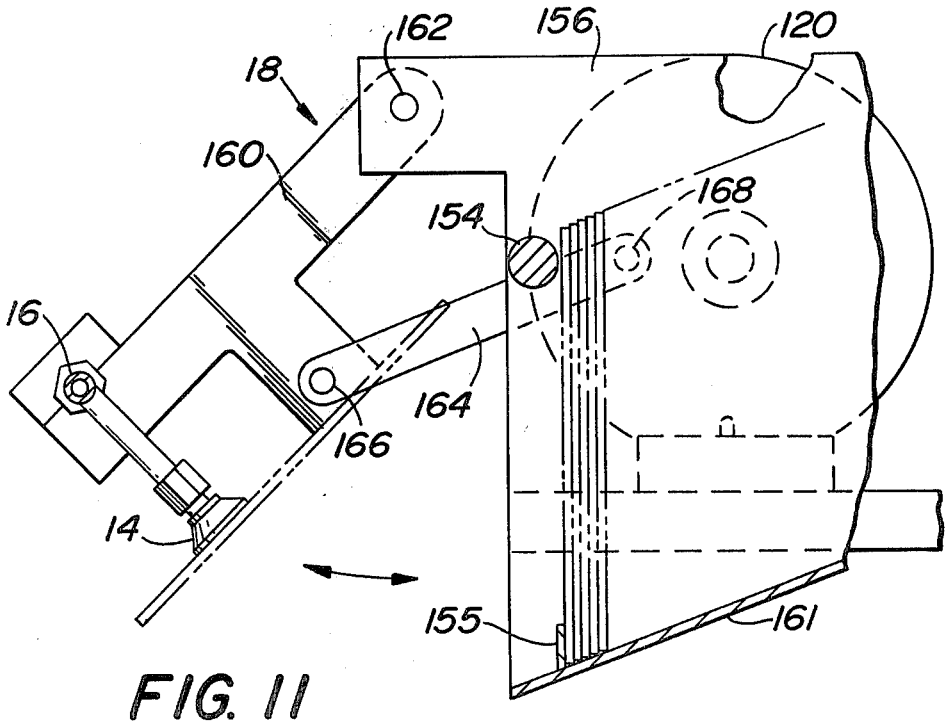

When first pivotable member 160 reaches the position shown in FIG. 11, the slot in timing disk 120 should be aligned with sensor 122. This occurs at time Tf as already explained in connection with chart (d) in FIG. 19. The microcomputer detects alignment of the slot and sensor and causes the solenoid valve 172 to close to remove the suction pressure from cups 14. The cups release the envelope, and the envelope drops onto conveyor 22.

B. First Shear Station 26

Figure 6:
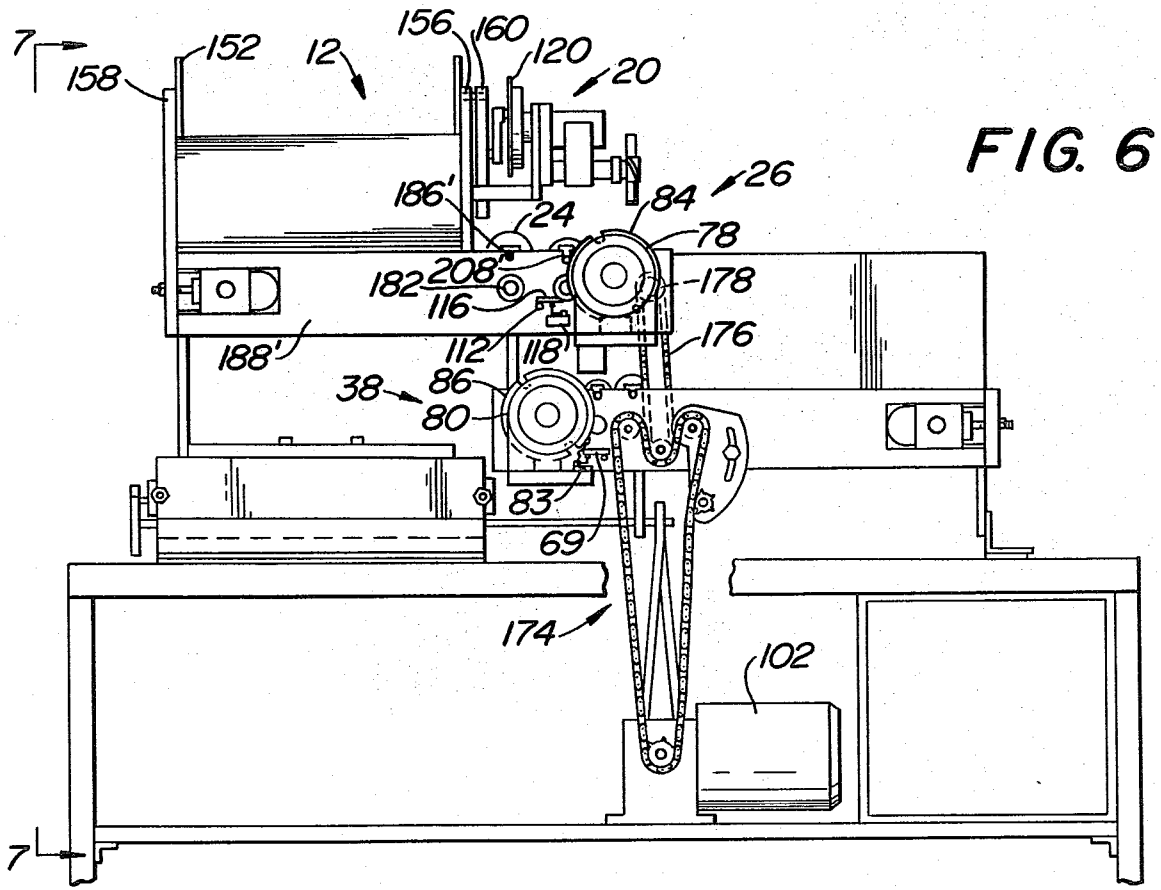
FIG. 6 is a rear view of the envelope opener of FIG. 1.

Conveyor 22 is driven by main motor drice 102 via chain and sprocket assembly 174, belt 176, driven roller 178, belt 180 and driven roller 182. See FIGS. 6 and 8. Conveyor belt 22 is driven abut idler roller 184 by driven roller 182. See FIG. 8.

The envelope is transported on conveyor belt 22 to grooved roller 24 at the entrance to the first shear station 26. Grooved roller 24 is mounted in notches 186, 186' in side panels 188, 188' respectively. The notches permit vertical displacement of the roller to accommodate varying envelope thicknesses The roller 24 is provided with plural ribs 190 which define a series of grooves 192. See FIG. 18. The ribs and grooves serve to smooth out any ruffles or bent edges in an envelope entering between rollers 24 and 182 at the first shear station.

Figure 7:
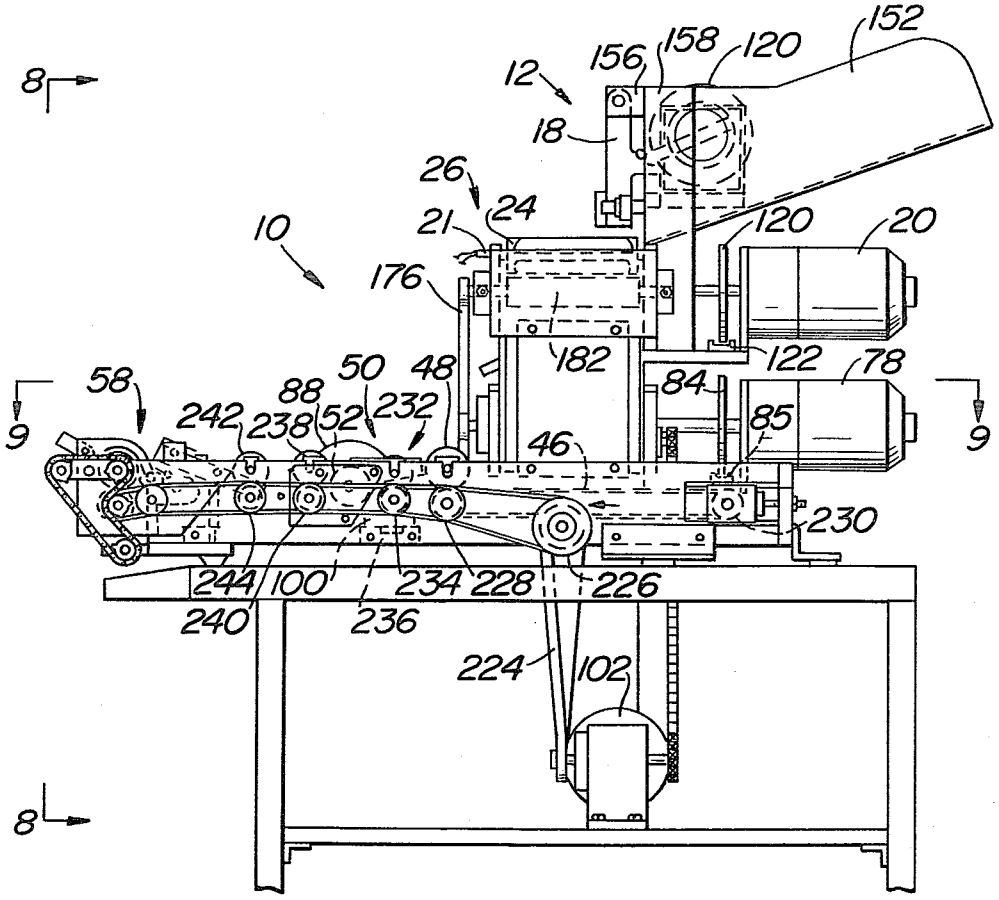
FIG. 7 is a right side view of the envelope opener of FIG. 1 taken along the line 7—7 in FIG. 6.

As the envelope passes through the shear station, it is monitored by the microcomputer. The microcomputer detects the action of feeler arm 114 on shaft 112 as already explained. See FIGS. 6 and 13. The feeler arm 114 is disposed upstream of idler means 194 and driven roller 196. See FIGS 8 and 13. Idler means 194 comprises a housing 198 having plural passages 200 in side-by-side relation and an inclined bottom surface. See FIG. 13. A rotatable shaft 202 is mounted in opening 204. The shaft 202 and opening 204 extend through the housing 198 perpendicular to the direction of travel of the envelope. The opening 204 connects the passages 200. An idler roller 206 is mounted in each passage 200 on shaft 202. Shaft 202 is mounted in notches 208, 208' in panels 188, 188' respectively. See FIGS. 7 and 8. Accordingly, idler rollers 206 may be displaced vertically to accommodate varying thicknesses of envelopes.

The envelope passes between idler means 194 and roller 196 and travels toward shear barrel 28. The leading edge E of the envelope abuts against the shear barrel 28. See FIG. 13. The rollers 194 and 196 cooperate with the barrel 28 to align the envelope in this position. The inclined bottom surface of housing 198 keeps the leading edge of the envelope in position adjacent the shear barrel and anvil.

When the envelope has been aligned, the shear barrel 28 rotates to bring shear blade 30 into contact with the leading edge E. As the blade travels towards the leading edge, it slides against an arcuate surface 197 at the portion of housing 198 facing the barrel. The shear blade 30 cooperates with anvil 90 to shear the leading edge. Anvil 90 is mounted on an adjustable block end screw assembly 210. The block end screw assembly 210 permits adustment of the lateral position of the anvil 90 to assure accurate and complete shearing of the leading edge.

The shear blades 30, 30' are secured to the shear barrel 28 as shown in FIGS. 13 and 15. The shear blades are skewed with respect to the longitudinal axis of the barrel. This ensures an accurate shearing action when a blade contacts the anvil 90. It also reduces the amount of torque to shear the envelope edge since a blade contacts only one point on the envelope edge at any given instant of time.

After the leading edge E of the envelope is sheared, the envelope passes through the longitudinal barrel opening 32 through idler roller 212 and driven roller 178. See FIG. 8. The envelope leaves rollers 212 and 178 and drops onto conveyor belt 34.

C. Second Shear Station 38

The main motor drive 102 drives conveyor 34 by the chain and sprocket assembly 174 and driven roller 214. See FIG. 8. The conveyor belt 34 is driven about roller 216 by a roller 214.

Conveyor belt 34 transports the envelope to the grooved roller 36 and the driven roller 214. Grooved roller 36 is identical to grooved roller 24. Roller 36 smooths out any ruffles or bent edges in the envelope. The smoothed envelope moves past the roller to idler means 218 and driven roller 196. Idler means 218 is identical to idler means 194. Idler means 218 cooperates with barrel 40 to align the envelope for shearing with the leading edge of the envelope abutting the barrel. The microcomputer scans microswitch 83 associated with actuator arm 69 at the second shear station to determine when the envelope should be sheared. The microswitch 83 and actuator arm 69 are operated in the same fashion as the microswitch 118 and actuator arm 116 in first shear station 26. The feeler arm and shaft assembly associated with the actuator arm 69 is the same as that shown in FIG. 13.

The envelope is sheared by shear blades 42, 42′ on barrel 40 in cooperation with an adjustable anvil assembly as shown in FIG. 13. After the envelope is sheared, it passes through the longitudinal opening 44 in barrel 40 to idler roller 220 and driven roller 222. The envelope passes through rollers 220 and 222 and is dropped onto conveyor belt 46.

D. Third Shear Station 50

Conveyor belt 46 is driven by main motor drive 130 via twisted belt 224, pulley 226 and rollers 228 and 230. See FIG. 7. The envelope is transported by conveyor belt 46 to grooved roller 48 and roller 228. Grooved roller 48 smoothes out any ruffles in the envelope and passes the envelope to idler means 232 and driven roller 234. Idler means 232 is identical to idler means 194. The envelope passes between idler means 232 and roller 234 and is temporarily arrested in position with the leading edge of the envelope abutting against the shear barrel 52. Shear barrel 52 is identical to barrel 28. In this position, the envelope is aligned for shearing.

Figure 9:
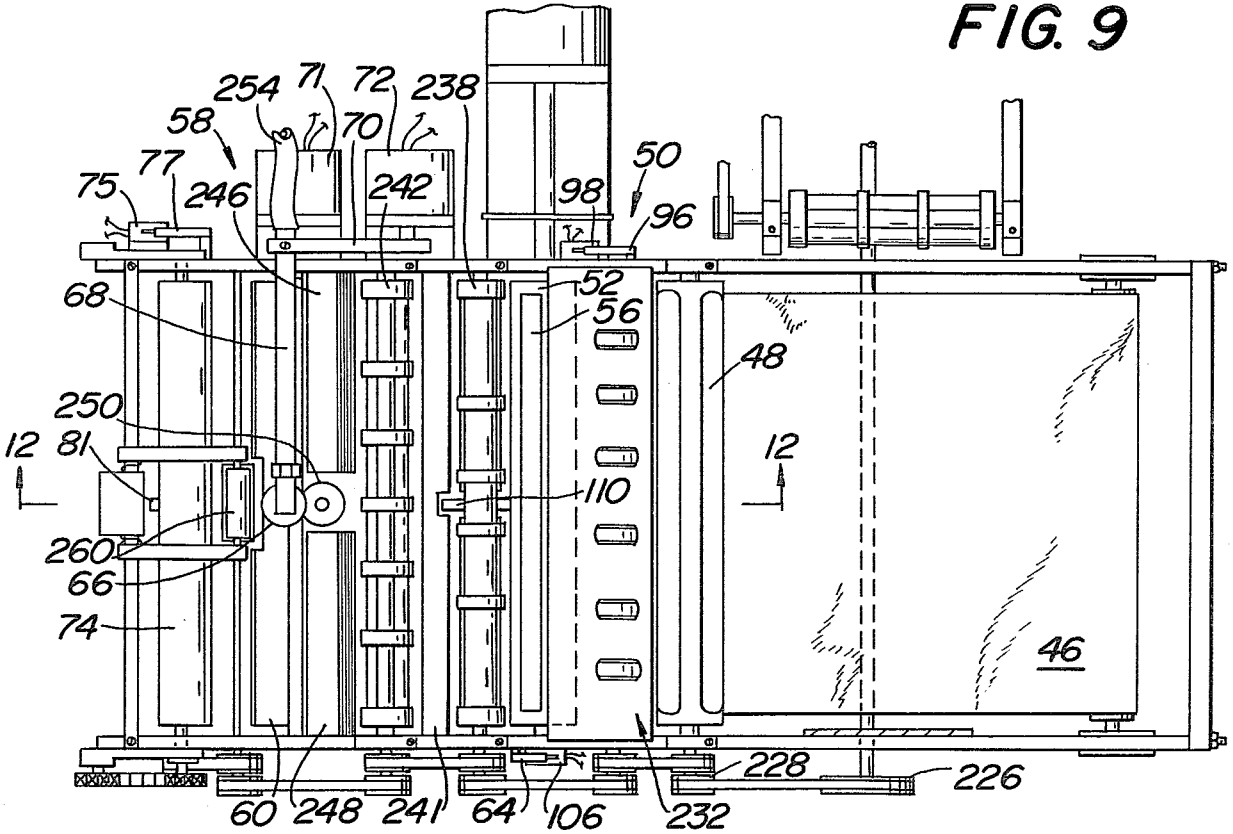
FIG. 9 is a plan view of the third shear station and the peel back station of the envelope opener of FIG. 1.

The microcomputer scans microswitch 98 associated with actuator arm 96 at the third shear station as already explained. See FIG. 9. The actuator arm is connected to the shaft 94. See FIG. 12. The feeler arm 92 is secured to shaft 94 and is depressed by the envelope as it passes through idler means 232 and roller 234 as already explained.

When the envelope is aligned for shearing, the microcomputer causes the barrel 52 to be rotated. Shear blade 54 cooperates with anvil 100 to shear the leading edge of the envelope. The lateral position of the anvil 100 may be adjusted by means of block and screw assembly 236. See FIG. 12.

After the leading edge of the envelope has been sheared, the envelope passes through barrel opening 56 to idler roller 238 and driven roller 240. As the envelope leaves rollers 238 and 240, it depresses feeler arm 110 mounted on shaft 108. As a result, actuator arm 160 triggers microswitch 64 as already explained. See FIGS. 9 and 12. The microcomputer scans microswitch 98 to detect any jam condition at third shear station 50. The envelope passes over an elongated table 241 to idler rollers 242 and driven roller 244. See FIGS. 9 and 12. The envelope passes between rollers 242 and 244 to spaced tables 246 and 248 at peel back station 58. See FIG. 9.

E. Peel Back Station 58

The envelope passes over the tables 246 and 248. The leading edge of the envelope abuts against swingable gate 60 operated by solenoid 71. See FIGS. 9 and 16. The gate 60 and rollers 242 and 244 arrest the envelope in the position shown in FIG. 16.

The envelope is sandwiched between suction cups 66 and 250. Suction cup 66 is coupled through hollow rod 68 and pressure conduit or tubing 254 to solenoid valve 258. See FIGS. 9 and 16. At time Tf, the microcomputer opens valve 258 to apply suction pressure to cups 66 and 250. See chart (k) in FIG. 19. Suction cup 66 grips the top panel of the envelope. Suction cup 250 grips the bottom panel of the envelope. Suction is applied to cup 250 via a conduit 256. The suction pressure applied to cup 250 is somewhat stronger than the pressure applied to cup 66. The suction applied to cup 250 is made stronger than the suction applied to cup 66 to prevent an unsheared envelope from being lifted by cup 66. If an unsheared envelope were lifted and then released by cup 66, it would become jammed at the peel back station. If the envelope has been properly sheared, suction cups 66 and 250 separate the top and bottom panels of the envelope.

Rod 68 is secured to linkage arm 70 which is raised and lowered by solenoid 72. See FIGS. 9 and 16. After suction prssure is applied to cup 66, the solenoid 72 is actuated by the microcomputer to raise rod 68 via linkage arm 70 to the position shown in broken lines in FIG. 16. The top panel of the envelope is peeled back by suction cup 66 as the rod 68 is raised to this position. The stronger suction pressure applied to cup 250 retains the bottom panel of the envelope in position during this time.

After the top panel of the envelope has been peeled back by cup 66, the microcomputer operates solenoid valve 258 to remove the suction pressure from the cups 66 and 250. Thereafter, the microcomputer operates solenoid 71 to lower the gate 60 to the position shown in broken lines in FIG. 16. The top panel of the envelope drops onto spring-loaded roller 260. The bottom panel of the envelope passes between the spring loaded roller and driven roller 262. The bottom panel of the envelope thereafter passes between ironing rollers 74 and 76 and over feeler arm 81 to the delivery end of the machine. The peeled back top panel of the envelope also travels between spring loaded roller 260 and driven roller 262 and ironing rollers 74 and 76 over the feeler arm 81. When the feeler arm 81 is depressed by the passing panel of the envelope, the actuator arm 77 triggers microswitch 75 to indicate to the microcomputer that an envelope has been opened by the machine.

Improved Shear Station

Figure 24:
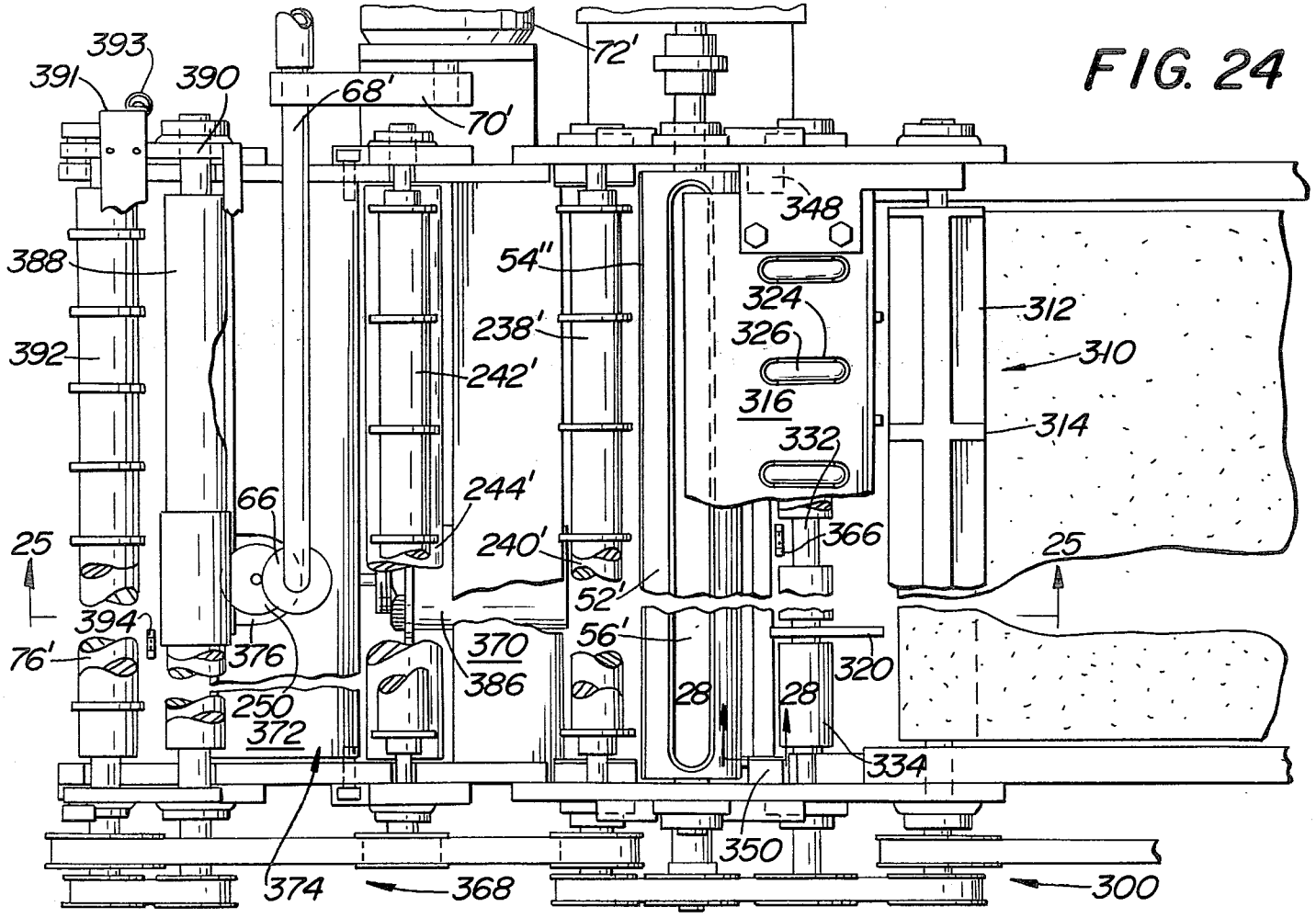
FIG. 24 is a top plan view of the improved shear station and peel back station according to the present invention.

Referring now to FIG. 24, there is shown an improved shear station 300 for use in the envelope opener 10 previously described.

Figure 25:
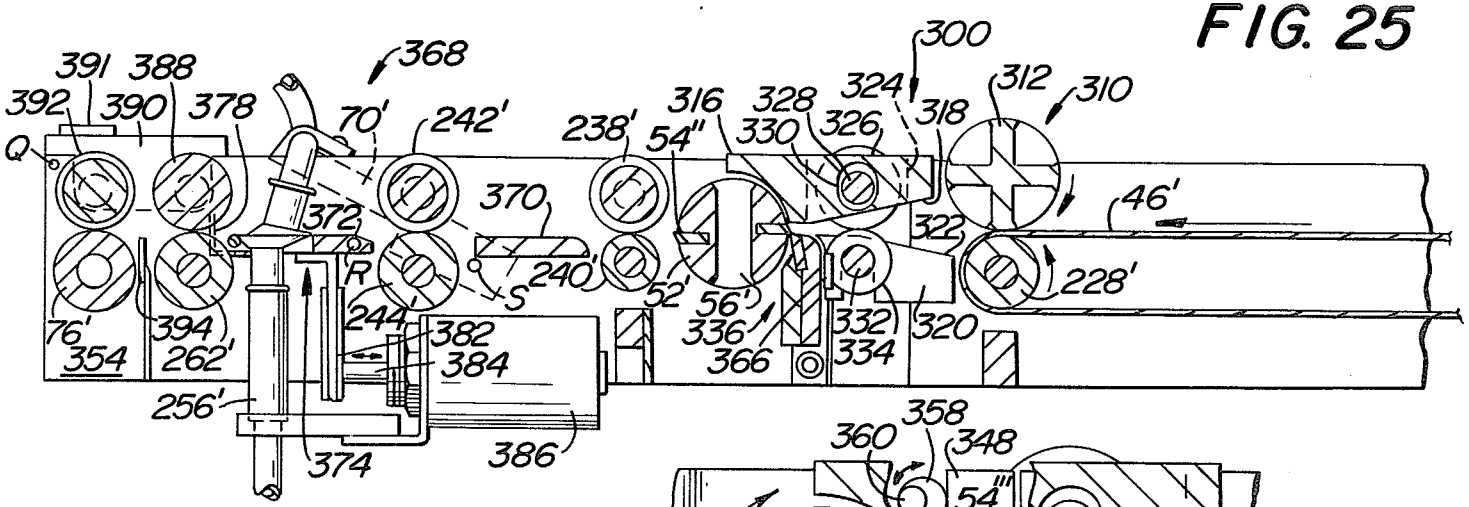
FIG. 25 is a cross-section of the improved shear station and peel back station in FIG. 24.

The improved shear station 300 includes a slotted insertion roller 310 having plural circumferentially spaced ribs 312 and plural axially spaced peripheral projections 314. The ribs 312 and projections 314 press an envelope against the conveyor 46′ which is partially wrapped around roller 228′. See FIG. 25. The insertion roller 310 and conveyor 46′ cooperate to transport the envelope between a hold down plate 316 having an upwardly sloped surface 318 and plural spaced fingers 320 mounted on a rotatable shaft 332. Each of the fingers 320 are provided with a downwardly sloped surface 322. The hold down plate 316 is provided with plural longitudinally spaced slots 324 through which plural longitudinally spaced rollers 326 extend. The rollers 326 are mounted on a rotatable shaft 328 disposed within an oblong opening 330 in the hole down plate 316. Accordingly, the shaft 328 and rollers 326 are vertically displaceable within the oblong opening 330.

Plural entrance drive rollers 334 are also mounted on the shaft 332 between the fingers 320. An envelope entering the space between plate 316 and fingers 320 are guided by the upwardly sloped surface 318 of plate 316 and the downwardly sloped surfaces 322 of fingers 320 to the nip between rollers 326 and rollers 334. A thick envelope will cause the rollers 326 to be vertically displaced within constraint of the oblong opening 330. This facilitates passage of the envelope between rollers 326 and rollers 334 to the shear barrel 52'.

The shear barrel 52' is provided with a longitudinal opening 56' for transporting an envelope as previously described. The barrel is also provided with a pair of circumferentially spaced blades 54'and 54''''. See FIG. 25. The shear barrel 52' has a longitudinal axis of rotation L. See FIG. 26. An anvil assembly 336 is disposed proximal to and upstream of the shear barrel 52'. The anvil assembly 336 comprises a pair of upstanding plates 338, 340 having facing inclined surfaces 342, 344, respectively, which define a recess (not numbered) within which an anvil blade 346 is seated. The upstanding plates 338, 340 are secured together by any suitable means and are rigidly fastened to a pair of pivotable upstanding arms 348, 350 at their extremities. The upstanding arms 348, 350 are pivotably mounted on a longitudinally extending rod 352 journalled in a frame 354. The pivot point P of the upstanding arms is disposed upstream of the shear barrel 52' and below the longitudinal axis of rotation L of the shear barrel.

Figure 26:
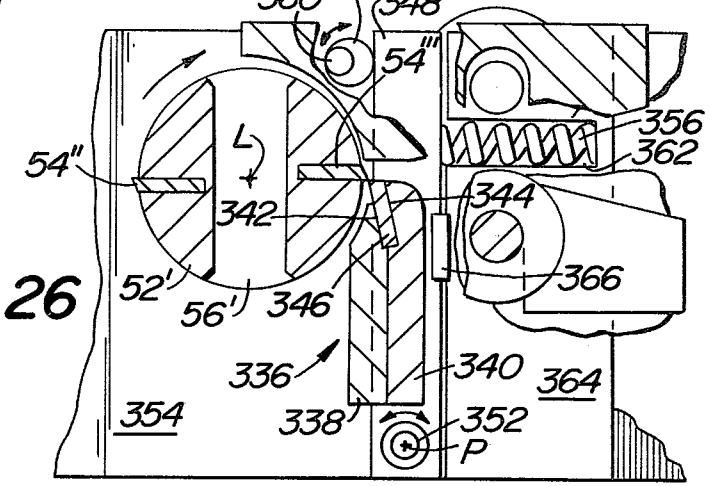
FIG. 26 is an enlarged partial cross-section of the shear station anvil assembly.

At least one of the pivotable upstanding arms 348, 350, say arm 348, is spring-urged by a helical spring 356 to a "home" position against an eccentric 358 as shown in FIG. 26. The eccentric 358 is mounted on a longitudinally extending stub shaft 360. The shaft 360 is mounted on the frame 354. A jam nut is fastened to the end of shaft 360 outside the frame 354. The eccentric and shaft may be formed by lathing a conventional socket head cap screw. The eccentric 358 acts as a limit stop which holds the upstanding arm 348 in the "home" position. The "home" position of the arm 348 is adjusted by placing a wrench over the eccentric 358 inside of the frame 354 and by rotating the eccentric.

The helical spring 356 is seated in a laterally extending recess 362 in a housing 364 within which the shafts 328 and 332 are journaled. The helical spring presses the upstanding arm 348 towards the shear barrel 52' against the eccentric 358. The eccentric 358 is adjusted, prior to operation, so that the anvil blade 344 is in the "home" position. In the "home" position, the anvil blade 346 will be spaced from the curved surface of the shear barrel 52'. As described hereinafter, the tip of the anvil blade 346 in the "home" position is spaced radially inwardly of the tip of the shear blade 54'' or 54''' with respect to the axis of rotation L of the shear barrel. Thus, the "home" position of the anvil blade 346 is not the position at which the anvil blade and the shear blade co-act to shear an envelope.

Preferably, the shear barrel blades 54'', 54''' and the anvil blade 346 are made of hardened tool steel. A hardened tool steel post 345 is inserted in a vertical channel 347 (FIG. 24) which is machined into one of the ends of anvil plate 338, say the end of the anvil plate adjacent upstanding arm 350. The post 345 is shown in FIG. 28 but has been omitted from the details of FIG. 26 for purposes of clarity. The post 345 is clamped in position in the vertical channel by the upstanding arm 350 and extends approximately ½ inch above the tip of anvil blade 346. The post 345 abuts the end of the anvil blade 346 and has a front planar surface aligned with the tip of the anvil blade as shown in FIG. 28.

During a shearing operation, the shear blade 54'' or 54''' strikes the front planar surface of the post 345 causing the anvil assembly to pivot about axis P away from the "home" position. In the preferred embodiment, the anvil assembly is pivoted approximately 1/32 inch from the "home" position against the action of spring 356. The spring 356 then causes the assembly to pivot back towards the "home" position. Before the assembly reaches the "home" position, however, the shear blade 54'' or 54''' and the anvil blade 346 co-act to shear the envelope edge. The envelope edge is sheared as the anvil blade is returning "on the fly" to the "home" position.

The shear and anvil blades, therefore, both move to shear the envelope. Preferably, during a shear operation, the shear and anvil blades make contact at an angle which produces a self-sharpening effect. Any wear of the anvil blade (typically 1/1000 inch) will be compensated for by the initial 1/32 inch displacement of the anvil blade and its return towards the "home" position. Gradual wear of the anvil blade will only shift the position at which the anvil blade co-acts "on the fly" with the shear blade towards the "home" position without jeopardizing the shearing operation itself. Thus, the assembly is self-aligning.

In operation, an envelope is transported between the slotted insertion roller 310 and conveyor 46' towards the shear barrel 52'. See FIG. 25. The envelope may contact the upwardly sloped surface 318 of the hold down plate 316 or the downwardly sloped surfaces 322 of the spaced fingers 320. These surfaces guide the envelope to the nip between rollers 326 and 334. The rollers transport the envelope to the shear barrel 52'. The leading edge of the envelope moves into abutting alignment with the peripheral curved surface of the shear barrel 52'. The presence of the leading edge of the envelope at the shear barrel 52' is detected by a photocell 366 mounted on the plate 340. See FIGS. 24 and 26. When the photocell detects the leading edge of the envelope, it generates an input signal to the microcomputer, and the microcomputer causes the shear barrel 52' to rotate from the poised position to shear the leading edge of the envelope. The shear blade 54'' or 54''' contacts the post 345 causing the anvil assembly 336 to pivot away from the "home" position. The assembly returns towards the "home" position under force of spring 356. The anvil blade 346 and the shear blade 54'' or 54''' co-act "on the fly" to shear the envelope edge. The envelope then passes through the longitudinal opening 56' of the shear barrel 52' as previously described.

The photocell 366 also detects the trailing edge of the envelope as the envelope proceeds through the longitudinal opening 56' in the shear barrel 52'. Upon detection of the trailing edge of the envelope by the photocell 366, the micrcomputer rotates the shear barrel 52' to the poised position in preparation of the next shearing operation. The photocell therefore replaces the feeler arms 92 and 110 in the shear station assembly shown in FIG. 12.

If an overly thick envelope is admitted to the space between plate 316 and fingers 320, the envelope will vertically displace the rollers 326 as the envelope is transported towards the shear barrel 52'. The envelope leading edge will move into abutting alignment with the peripheral surface of the shear barrel 52' as already described. When the shear barrel 52' is rotated from the poised position to effect a shearing operation, the shear barrel blade 54'' or 54''' and the moving anvil blade 346 may not be able to shear the envelope edge due to the thickness of the envelope. In that case, shear blade 54'' or 54''' brushes the envelope edge and presses the envelope against the anvil blade, forcing the anvil assembly to pivot away from the shear barel 52' against the force exerted by the spring 356. The shear barrel 52' continues to rotate, without shearing the leading edge of the envelope, and the barrel 52' reaches the transport position wherein the envelope passes through the longitudinal opening 56'. Since the top front portion of the plate 338 is curved concavely below the tip of anvil blade 346, the plate will not obstruct movement of the envelope towards shear barrel 52'. When the envelope passes through the longitudinal opening 56', the spring 356 returns the anvil assembly 348 to the "home" position in preparation for the next shearing operation.

As a result, an overly thick envelope which cannot be sheared by the shear blade and the anvil blade is permitted to pass through the improved shear station 300 without causing a jam condition.

The structure and operation of the improved shear station 300 has been described in connection with the third shear station immediately preceding the improved peel back station 368 in FIG. 24. The other two shear stations of the envelope opener have like structure to enable operation as described in connection with improved shear station 300.

Improved Peel Back Station

The improved peel back station 368 includes an elongated table 370. See FIG. 25. As an envelope is transported through the shear barrel 52', the envelope enters the nip between rollers 238' and 240' and slides over the table 370 to the nip between rollers 242' and 244'. Rollers 242' and 244' transport the envelope over the table portion 372 of a pivotable gate 374. The gate 374 is pivotable about pivot point R. See FIG. 27. The gate 374 is provided with a U-shaped opening 376 and a stop member 378.

A lower suction cup 250' connected to conduit 256' is disposed within the U-shaped opening 376 when the gate 374 is in the position indicated in solid lines in FIG. 27. A longitudinally extending support rod 380 is disposed in proximity to the gate stop member 378 at approximately the elevation of the top surface of the table portion 372 of gate 374.

The gate 374 is supported from below by means of an inverted L-shaped member 382 which is secured to the bottom of gate 374. A retractable plunger 384 operated by a linear solenoid 386 abuts member 382 and maintains the member 382 in an upstanding position when fully extended.

An upper suction cup 66' is connected through a conduit 386 and a hollow rod 68' to a linkage arm 70' which is secured to the rotatable shaft of a rotary solenoid 72'. The longitudinal axis of rotation of the linkage arm 70' is indicated as S in FIGS. 24 and 27.

A separation roller 388 is rotatably mounted in a linkage arm 390 which is pivotably secured to the frame 354. The linkage arm 390 is spring-coupled to the frame by spring 393. See FIG. 24. The pivot point of the linkage arm 390 is indicated as pivot point Q is FIG. 25. A driven roller 262' is disposed below the separation roller 388.

An exit roller 392 is disposed downstream of the separation roller 388. The exit roller is rotatably mounted in the linkage arm 390. The longitudinal axis of rotation of the exit roller 392 is at approximately the same elevation as the longitudinal axis of rotation of the separation roller 388. Disposed below the exit roller 392 is a driven roller 76'. A photocell 394 is disposed intermediate the rollers 76' and 262' below the elevation of the nips of rollers 76', 392 and 262', 388. The photocell 394 detects the presence or absence of an envelope in the space between the nips of rollers 76',392 and 262',388.

In operation, an envelope is transported by rollers 238', 240' to the elongated table 370. The envelope slides over the elongated table 370 and enters the nip between rollers 242',244'.During this time, the linkage arm 70' is in the raised position indicated in broken lines in FIG. 26, and the gate 374 is maintained in the horizontal position by the L-shaped member 382 and plunger 384.

The rollers 242',244' transport the envelope over the table portion 372 of the gate 374. The leading edge of the envelope abuts the stop member 378.

When the photocell 366 in shear station 310 detects the absence of the trailing edge of the envelope, the microcomputer waits a preselected interval of time and then actuates the rotary solenoid 72' to lower the linkage arm 70' by rotating the arm about the pivot points S. At this time, a vacuum is applied to the upper and lower cups 66' and 250'. The microcomputer then waits another preselected interval of time and then actuates the rotary solenoid 72' to raise the linkage arm 70'. As the linkage arm 70' is rotated upwardly about the longitudinal axis of rotation S, the upper cup 66' pulls the top panel of the envelope upwardly while the lower suction cup retains the bottom panel of the envelope in position on the gate 374. Accordingly, the contents of the envelope are exposed.

After actuating the rotary solenoid 72' to raise the linkage arm 70', the microcomputer waits a suitable preselected intervalof time and then shuts off the vacuum to cups 66' and 250'.

During this time, the trailing portion of the envelope is retained in the nip between rollers 242',244' so that the rollers drive the leading edge of the bottom panel of the envelope against the stop member 378.

After the vacuum to cups 66', 250' is shut off, the top panel of the envelope drops onto the separation roller 388. After shutting off the vacuum, the microcomputer operates the linear solenoid 386 to retract the plunger 384. As the plunger 384 is retracted, the gate 374 and L-shaped member 382 pivot under gravity to the position indicated in broken lines in FIG. 27. As the gate 374 drops, it clears the space proximal to the nip between rollers 262,388. The support rod 380 prevents the bottom panel of the envelope from following the gate. Accordingly, the rollers 262',388 grab the leading edge of the bottom panel of the envelope and transport the envelope, with its contents exposed, to the exit rollers 76',392. The exit rollers 76',392 transport the "peeled back" envelope to a delivery point downstream of the rollers.

After the leading edge of the "peeled back" top panel of the envelope (now the trailing edge of the envelope) passes the photocell 394, the microcomputer activates the linear solenoid 386 to cause the plunger 384 to become fully extended to restore the L-shaped member 382 and the gate 374 to the horizontal position.

If an overly thick envelope enters the nip between rollers 262',388 when the gate 374 is dropped, the envelope will cause the arm 390 carring roller 388 and roller 392 to pivot upwardly about the pivot point Q. This facilitates passage of the envelope through the space between rollers 262',388 and 76',392 without causing a jam condition in the peel back station. Moreover, if a jam condition does somehow occur in the peel back station, the arm 390 can be manually pivoted upwardly to clear the envelope from the peel back station.

The present invention may be embodied in other specific forms without departing from the spirit or essential attributes thereof and, accordingly, reference should be made to the appended claim, rather than to the foregoing specification, as indicating the scope of the invention. We claim 1. An improved envelope opener, comprising:
a rotatable shear barrel having at least one shear blade for shearing an edge of an envelope;
a pivotable anvil assembly operatively asociated with said shear barrel;
said anvil assembly having an anvil blade,
contact means operatively associated with said shear barrel and said anvil assembly and disposed in relation to said anvil blade to contact said shear blade as said shear barrel rotates and thereby pivotably displace said anvil assembly from a home position with respect to said shear barrel;
means for pivotaby returning said anvil assembly towards said home position with respect to said shear barrel as said shear barrel continues to rotate;
a pivotable gate disposed downstream of said shear barrel;
said gate having a stop member;
means for transporting said envelope from said shear barrel to said gate;
means for causing said gate to pivot downwardly to pass an envelope, and
a support rod disposed in proximity to said gate stop member for supporting said envelope when said gate is pivoted downwardly.

2. The improved envelope opener according to claim 1 wherein said anvil assembly includes at least one pivotable upstanding arm and said means for returning said anvil assembly includes an adjustable limit stop and means for resiliently urging said upstanding arm into contact with said limit stop.

3. The improved envelope opener according to claim 2 wherein said limit stop is an eccentric which is rotatably mounted upstream and above the pivot point of said upstanding arm .

4. The improved envelope opener according to claim 1 including a hold down plate having an upwardly sloping surface disposed upstream of said shear barrel, said hold down plate having plural longitudinally spaced slots, and plural vertically displaceable spaced rollers partially disposed within said slots, and plural spaced fingers mounted below said plate, each of said fingers having a downwardly sloping surface, said plate and said fingers defining a region through which said envelope is transported to said shear barrel.

5. The improved envelope opener according to claim 1 including a separation roller rotatable about a longitudinal axis disposed downstream of said gate stop member, said separation roller being mounted on an arm which is pivotable upwardly about a point disposed downstream of said separation roller longitudinal axis.

6. An improved shear station, comprising:
a rotatable shear barrel having at least one shear blade;
a moveable anvil assembly spaced from the shear barrel, said anvil assembly having an anvil blade for shearing an edge of an envelope transported towards the shear barrel in cooperation with said shear blade;
first means operatively associated with said anvil assembly and said shear barrel for moving said anvil assembly away from a home position with respect to said shear barrel as said shear barrel rotates;
second means for moving said anvil assembly back towards said home position such that said anvil blade and shear blade approach each other as said shear barrel continues to rotate;
whereby said anvil blade and shear blade cooperate to shear said envelope edge as said anvil assembly moves back to said home position.

7. The improved shear station according to claim 6 including a hold down plate having an upwardly sloping surface disposed upstream of said shear barrel, said hold down plate having plural longitudinally spaced slots, and plural vertically displaceable spaced rollers partially disposed within said slots, plural spaced fingers mounted below said plate, each of said fingers having a downwardly sloping surface, said plate and said fingers defining a region through which said envelope is transported to said shear barrel.

8. The improved shear station according to claim 6 wherein said first means for moving said anvil assembly away from said home position includes a post secured to said anvil assembly, said post extending in elevation above said anvil blade such that said shear blade contacts said post as said shear barrel rotates to cause anvil assembly to move away from said home position.

9. The improved shear station according to claim 6 wherein said second means includes means for resiliently urging said anvil assembly towards said home position and an adjustable limit stop for maintaining said anvil assembly in said home position.

10. The improved shear station according to claim 9 wherein said limit stop is a rotatable eccentric.

11. An improved peel back station for separating the top and bottom panels of a sheared envelope, comprising:
a moveable gate having a stop member for obstructing the path of movement of an envelope and a table portion for supporting said envelope when said gate is in a first position;
means for urging said envelope against said stop member;
means for separating the top and bottom panels of the envelope while said envelope is urged against said stop member;
means for causing said gate to move away from said first position to a second position to remove said stop member from the path of movement of the envelope;
support means disposed in proximity to said gate stop member for supporting the bottom panel of said envelope when said gate is moved to said second position;
means disposed downstream of said gate stop member for transporting said envelope past said support means when said gate is moved away from said first position.

12. The improved peel back station according to claim 11 wherein said means for transporting said envelope past said support means includes a driven roller, a vertically displaceable arm, and a separation roller rotatably mounted on said arm disposed in vertical alignment with said driven roller, whereby said arm and separation roller may be vertically displaced from said driven roller by an envelope.

* * * * *